United States Patent [19]

Matsuoka

[11] Patent Number: 4,941,318

[45] Date of Patent: Jul. 17, 1990

[54] AIR-FUEL RATIO FEEDBACK CONTROL SYSTEM HAVING SHORT-CIRCUIT DETECTION FOR AIR-FUEL RATIO SENSOR

[75] Inventor: Hiroki Matsuoka, Susono, Japan

[73] Assignee: Toyota Jidosha Kabushiki Kaisha, Aichi, Japan

[21] Appl. No.: 316,031

[22] Filed: Feb. 27, 1989

[30] Foreign Application Priority Data

Mar. 1, 1988 [JP] Japan ..... 63-45910

[51] Int. Cl.[5] ..... F02D 41/22; F02D 41/14

[52] U.S. Cl. ..... 60/274; 60/276; 60/285; 123/479; 123/489

[58] Field of Search ..... 60/274, 276, 285; 123/440, 489, 589, 479, 491

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,111,162 | 9/1978 | Norimatsu et al. | 123/489 |
| 4,127,088 | 11/1978 | Ezoe | 123/440 |
| 4,130,095 | 12/1978 | Bowler et al. | 123/440 |
| 4,177,787 | 12/1979 | Hattori et al. | 123/440 |
| 4,178,884 | 12/1979 | Norimatsu et al. | 123/489 |
| 4,235,204 | 11/1980 | Rice | 123/440 |
| 4,244,340 | 1/1981 | Herth et al. | 123/440 |
| 4,251,989 | 2/1981 | Norimatsu et al. | 123/440 |
| 4,401,086 | 8/1983 | Miyagi | 123/489 |
| 4,462,373 | 7/1984 | Kanno | 123/489 |
| 4,475,517 | 10/1984 | Kobayashi et al. | 123/489 |
| 4,502,443 | 3/1985 | Hasegawa et al. | 123/440 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,693,076 | 9/1987 | Chujo et al. | 60/274 |
| 4,707,985 | 11/1987 | Nagai et al. | 60/274 |
| 4,712,373 | 12/1987 | Nagai et al. | 60/274 |
| 4,720,973 | 1/1988 | Katsuno | 60/274 |
| 4,739,614 | 4/1988 | Katsuno et al. | 60/274 |
| 4,844,038 | 7/1989 | Yamato et al. | 123/479 |

FOREIGN PATENT DOCUMENTS

| | | | |
|---|---|---|---|
| 51-47486 | 4/1976 | Japan . | |
| 52-43030 | 4/1977 | Japan . | |
| 52-102934 | 8/1977 | Japan . | |
| 53-5332 | 1/1978 | Japan . | |
| 53-103796 | 9/1978 | Japan . | |
| 55-5417 | 1/1980 | Japan . | |
| 55-37562 | 3/1980 | Japan . | |
| 55-156228 | 12/1980 | Japan . | |
| 57-32772 | 7/1982 | Japan . | |
| 57-32773 | 7/1982 | Japan . | |
| 57-32774 | 7/1982 | Japan . | |
| 58-27848 | 2/1983 | Japan . | |
| 58-48755 | 3/1983 | Japan . | |
| 58-48756 | 3/1983 | Japan . | |
| 58-53661 | 3/1983 | Japan . | |
| 58-72646 | 4/1983 | Japan . | |
| 58-72647 | 4/1983 | Japan . | |
| 58-135343 | 8/1983 | Japan . | |
| 58-150038 | 9/1983 | Japan . | |
| 58-150039 | 9/1983 | Japan . | |
| 58-152147 | 9/1983 | Japan . | |
| 59-32644 | 2/1984 | Japan . | |
| 59-34438 | 2/1984 | Japan | 123/491 |
| 59-206638 | 11/1984 | Japan . | |
| 60-1340 | 1/1985 | Japan . | |
| 60-26138 | 2/1985 | Japan . | |
| 60-53635 | 3/1985 | Japan . | |
| 61-34330 | 2/1986 | Japan . | |
| 61-53436 | 3/1986 | Japan . | |
| 61-232346 | 10/1986 | Japan . | |
| 62-153545 | 7/1987 | Japan . | |

OTHER PUBLICATIONS

Gogi (Technical Report) No. 87-5098, Apr. 20, 1987.

*Primary Examiner*—Andrew M. Dolinar
*Attorney, Agent, or Firm*—Oliff & Berridge

[57] ABSTRACT

In an air-fuel ratio feedback control system including at least one air-fuel ratio sensor upstream or downstream of or within a catalyst converter provided in an exhaust gas passage, an actual air-fuel ratio is controlled in accordance with the output of the air-fuel ratio sensor, which is supplied to a pull-up type input circuit. When a short-circuited state is detected in the air-fuel ratio sensor, the feedback control by the air-fuel ratio sensor is prohibited.

34 Claims, 22 Drawing Sheets

PULL-DOWN TYPE
INPUT CIRCUIT

| Fig. 12A | Fig. 12B | Fig. 12C |
|---|---|---|

LEAN
RICH
A/F
TDR
CDLY 0
t1
t2
t3
t4
t5
t6
t7
t8
TDL
A/F'
(F1)
TDR
(-TDL)

LEAN
RICH
TDR
KIR
FAF1

RSL
RSR
KIL

| Fig. 16 A | Fig. 16B |
|---|---|

AIR-FUEL RATIO FEEDBACK CONTROL SYSTEM HAVING SHORT-CIRCUIT DETECTION FOR AIR-FUEL RATIO SENSOR

BACKGROUND OF THE INVENTION (1) Field of the Invention

The present invention relates to a method and apparatus for feedback control of an air-fuel ratio in an internal combustion engine having at least one air-fuel ratio sensor upstream or downstream of or within a catalyst converter disposed within an exhaust gas passage.

(2) Description of the Related Art

Known air-fuel ratio feedback control systems include a single air-fuel ratio sensor system whereby the air-fuel ratio is controlled in accordance with the output of a single air-fuel ratio sensor such as a single $O_2$ sensor; and a double air-fuel ratio sensor system whereby the air-fuel ratio is controlled in accordance with the outputs of two $O_2$ sensors upstream and downstream of a catalyst converter (see U.S. Pat. No. 4,739,614). Also, in such a single air-fuel ratio sensor, the above-mentioned $O_2$ sensor is installed upstream or downstream of the catalyst converter, or within the catalyst converter.

Note that according to a double air-fuel ratio sensor system, the fluctuation of the output of the upstream-side $O_2$ sensor is compensated by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double air-fuel ratio sensor system, even when the output characteristics of the upstream-side $O_2$ sensor are deteriorated, the emission characteristics are not deteriorated. That is, in a double air-fuel sensor system, even if only the output characteristics of the downstream-side $O_2$ are stable, good emission characteristics are still obtained.

As input circuits for the outputs of the $O_2$ sensors, use is made of a pull-down type circuit and a pull-up type circuit. The pull-down type input circuit is disadvantageous in that determination of the activation of the $O_2$ sensor is impossible when the base air-fuel ratio is lean, which will be later explained in detail.

On the other hand, the pull-up input circuit is advantageous in that determination of the activation of the $O_2$ sensor is possible even when the base air-fuel ratio is lean, but is disadvantageous in that, when the Ohd 2 sensor is short-circuited, determination of the activation of the $O_2$ sensor is erroneously carried out. Namely, when the $O_2$ sensor is short-circuited so that the output thereof is grounded (0 V), the output of the pull-up type input circuit is also 0 V, and therefore, the $O_2$ sensor is determined to be active, and as a result, the air-fuel ratio feedback control by the $O_2$ sensor is initiated. In this case, since the output of the pull-up type input circuit represents a lean state, the air-fuel ratio may be erroneously controlled toward the rich side, and as a result, the air-fuel ratio feedback control parameter may be adhered to a rich-side guard value, thus increasing HC and CO emissions and reducing the fuel consumption characteristics.

SUMMARY OF THE INVENTION

An object of the present invention is to provide a double air-fuel ratio sensor system and a single air-fuel ratio sensor system using a pull-up input circuit for an air-fuel ratio sensor upstream or downstream of or within a catalyst converter, whereby the emission characteristics, the fuel consumption characteristics, and the like are improved.

According to the present invention, an air-fuel ratio feedback control system including at least one air-fuel ratio sensor upstream or downstream of or within a catalyst converter provided in an exhaust gas passage, an actual air-fuel ratio is controlled in accordance with the output of the air-fuel ratio sensor, which is supplied to a pull-up type input circuit. When a short-circuit is detected in the air-fuel ratio sensor, the feedback control by the air-fuel ratio sensor is prohibited.

BRIEF DESCRIPTION OF THE DRAWINGS

The present invention will be more clearly understood from the description as set forth below with reference to the accompanying drawings, wherein:

FIGS. 7, 9, 11, 12, 12A–12C, 14, 14A, 14B, 15, 16, 16A, 16B, and 17 are flow charts shown the operation of the control circuit of FIG. 6;

DESCRIPTION OF THE PREFERRED EMBODIMENTS

Figure 1:
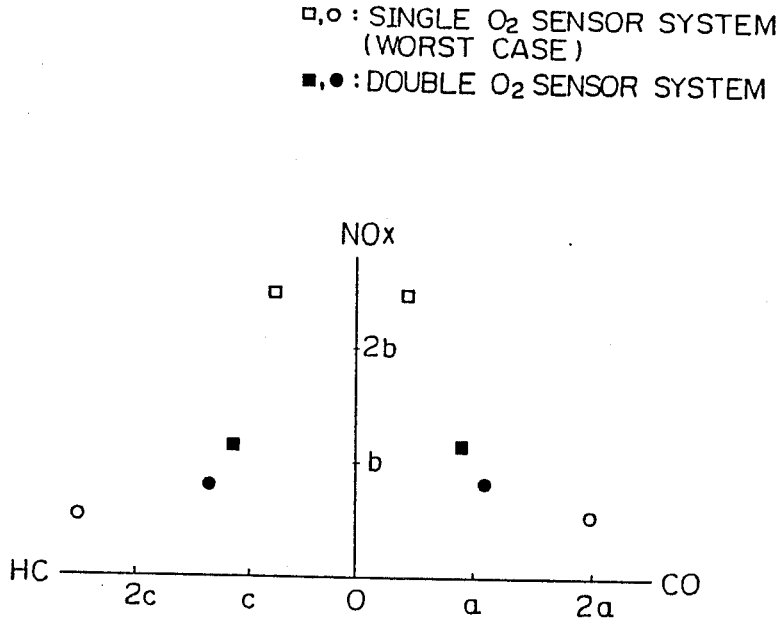
FIG. 1 is a graph showing the emission characteristics of a single $O_2$ sensor system and a double $O_2$ sensor system.
Figure 2:
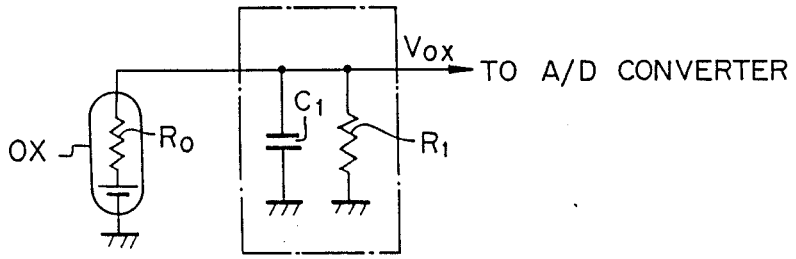
FIG. 2 is a circuit diagram illustrating an example of a pull-down input circuit for an $O_2$ sensor.
Figure 3:
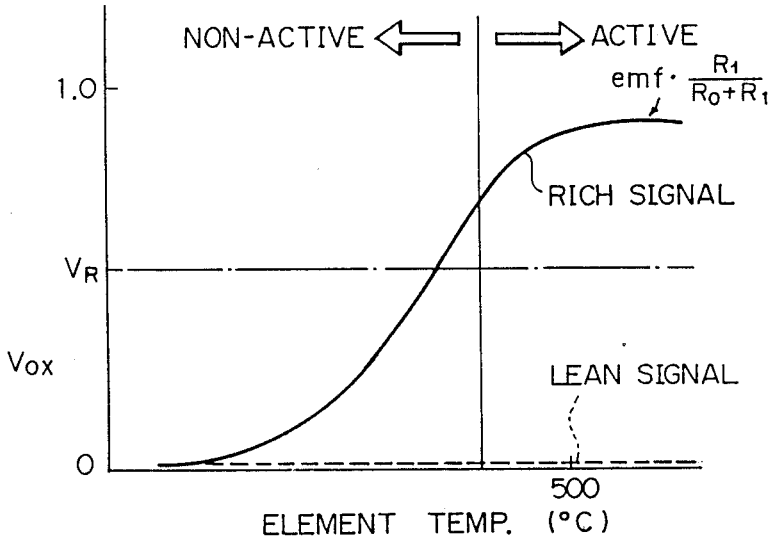
FIG. 3 is a diagram showing the output characteristics of the pull-down input circuit of FIG. 2.

A pull-down input circuit for the output $V_{OX}$ of an $O_2$ sensor OX is illustrated in FIG. 2 (see: Kogi (Technical Report) No. 87-5098, Innovation Society, Japan, Apr. 20, 1987). This pull-down type input circuit is comprised of a pull-down resistor $R_1$ and a capacitor $C_1$ for absorbing the noise. As illustrated in FIG. 3, when the element temperature of the $O_2$ sensor OX is low, the internal resistance $R_0$ thereof is large, and as a result, even when the base air-fuel ratio is rich and the electromotive force of the $O_2$ sensor OX is large, the output $V_{OX}$ of the $O_2$ sensor OX is still low. On the other hand, as illustrated in FIG. 3, when the element temperature of the $O_2$ sensor OX is high, the internal resistance $R_0$ thereof is small, and as a result, when the base air-fuel ratio is rich, the output $V_{OX}$ of the $O_2$ sensor OX is at a high level defined by $$V_{OX}=emf.R_1/(R_0+R_1)$$

Where emf is the electromotive force.

When use is made of the above-mentioned pull-down type input circuit for the output of the $O_2$ sensor, determination of the activation thereof is conventionally carried out by deciding whether or not the output $V_{OX}$ is higher than a predetermined value, or by deciding whether the output $V_{OX}$ is swung, i.e., once changed from a low level to a high level or vice versa. In this case, however, when the base air-fuel ratio is lean, it cannot be determined that the $O_2$ sensor OX is activated, even when the $O_2$ sensor OX actually is activated.

Figure 4:
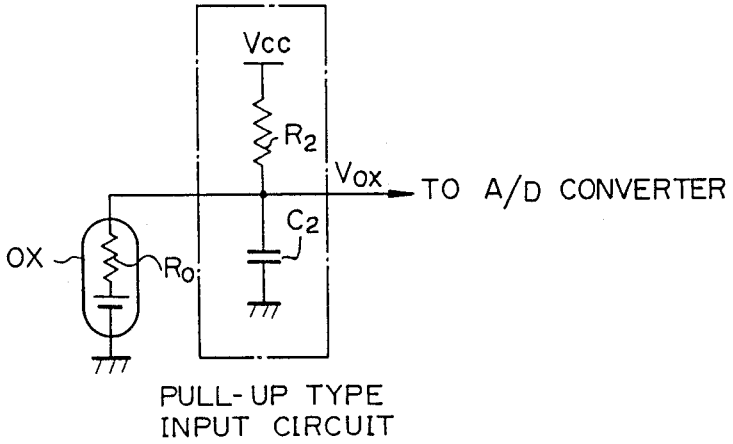
FIG. 4 is a circuit diagram illustrating an example of a pull-up input circuit for an $O_2$ sensor.
Figure 5:
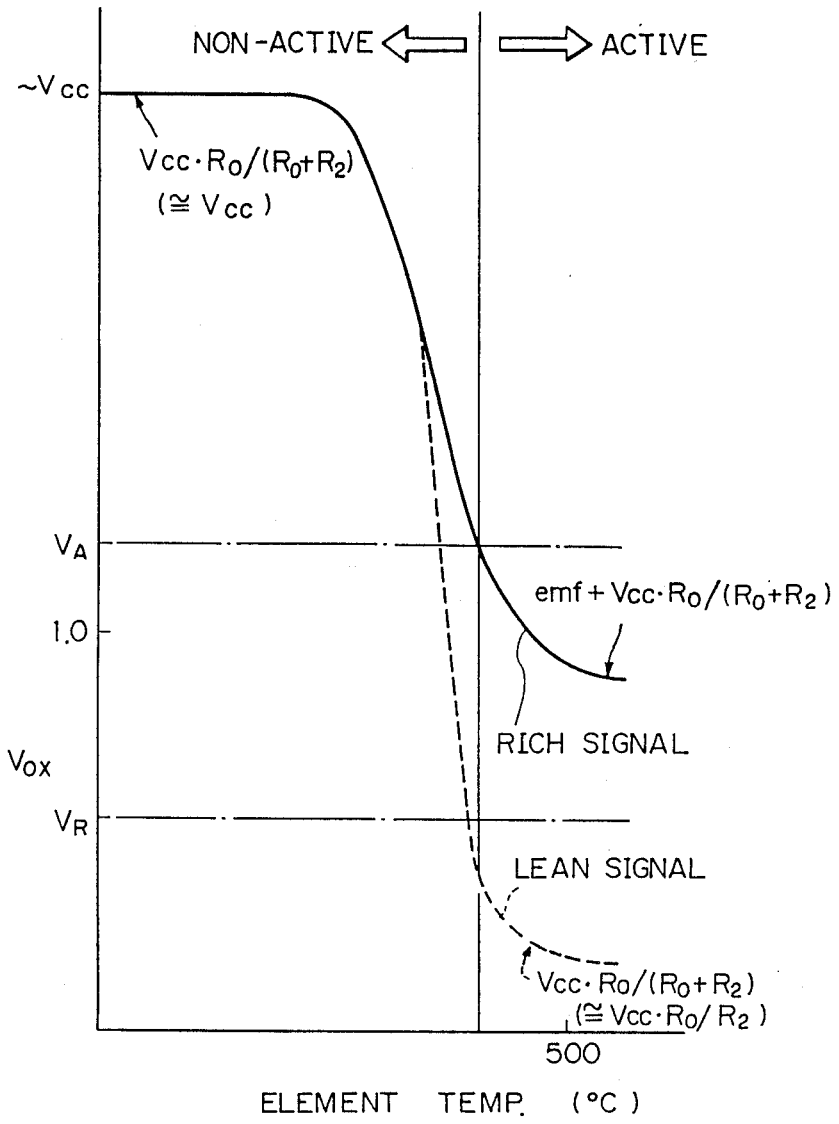
FIG. 5 is a diagram showing the output characteristics of the pull-up input circuit of FIG. 4.

There is also known a pull-up type input circuit for the output $V_{OX}$ of the $O_2$ sensor OX as illustrated in FIG. 4, which enables a determination of the activation of the $O_2$ sensor regardless of the base air-fuel ratio (see also the above-mentioned Giho (Technical Report)). That is, this pull-up type input circuit is comprised of a pull-up resistor $R_2$ and a capacitor $C_2$ for absorbing the noise. When the element temperature thereof is low, the internal resistance of the $O_2$ sensor OX is large compared with the resistance of the resistor $R_2$, and as a result, regardless of the base air-fuel ratio the output $V_{OX}$ of the $O_2$ sensor OX is pulled up to a definite level close to a power supply voltage $V_{cc}$ as illustrated in FIG. 5. This definite level is defined by $$V_{cc} \cdot R_0/(R_0+R_2)=V_{cc}$$

On the other hand, when the element temperature of the $O_2$ sensor OX is high, the internal resistance $R_0$ thereof is small compared with that of the resistor $R_2$, and as a result, as illustrated in FIG. 5, when the base air-fuel ratio is rich, the output $V_{OX}$ of the $O_2$ sensor OX is $$\text{emf}+V_{cc} \cdot R_0/(R_0+R_2).$$

When the base air-fuel ratio is lean, the output $V_{OX}$ of the $O_2$ sensor OX is defined by $$V_{cc} \cdot R_0/(R_0+R_2)=V_{cc} \cdot R_0/R_2.$$

Therefore, when use is made of the pull-up type input circuit for the output $V_{OX}$ of the $O_2$ sensor, determination of the activation of the $O_2$ sensor OX can be carried out by deciding whether or not the output $V_{OX}$ is higher than an activation level $V_A$, which is slightly higher than the rich output level of the $O_2$ sensor, after the engine is warmed-up.

In the above-mentioned pull-up type input circuit of FIG. 4, however, when the $O_2$ sensor OX is short-circuited, the output of the pull-up type input circuit is grounded (0 V) and the $O_2$ sensor is determined to be active, thus initiating an air-fuel ratio feedback control by the $O_2$ sensor. As explained above, in this case, the output of the $O_2$ sensor represents a lean state, and accordingly, the air-fuel ratio is erroneously controlled toward the rich side. In the present invention, such an overrich air-fuel controlled ratio can be avoided.

Figure 6:
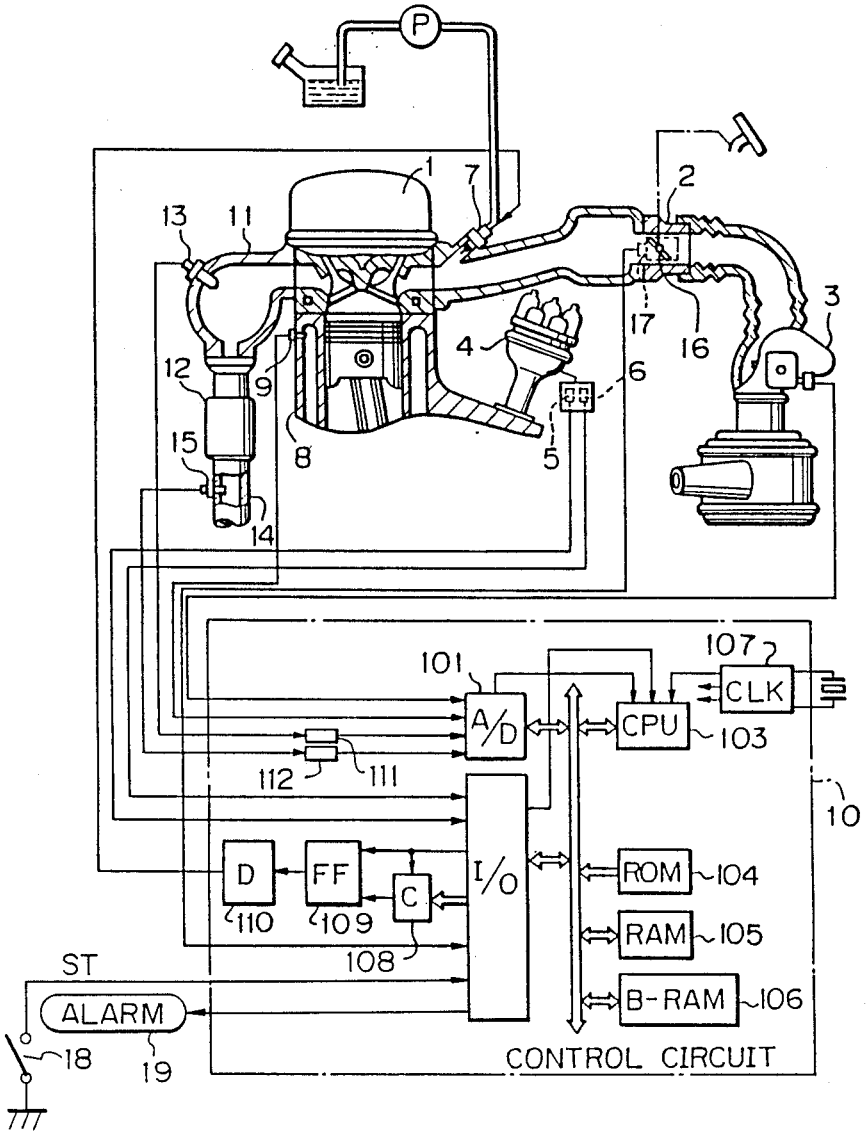
FIG. 6 is a schematic view of an internal combustion engine according to the present invention.

In FIG. 6, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air drawn into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank angle sensor 5 generates a pulse signal at every 720° crank angle (CA) and the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 6.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits that signal to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit those signals via pull-up type input circuits 111 and 112, respectively, to the A/D converter 101 of the control circuit 10.

Reference 16 designates a throttle valve, and 17 an idle switch for detecting whether or not the throttle valve 16 is completely closed.

Reference 18 designates a starter switch which is turned ON when the ignition switch (not shown) is located at the starter (ST) position.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is not erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the borrow-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

First, detection of a short-circuited state in the downstream-side $O_2$ sensor 15 will be explained with reference to FIGS. 7 through 11.

Figure 8:
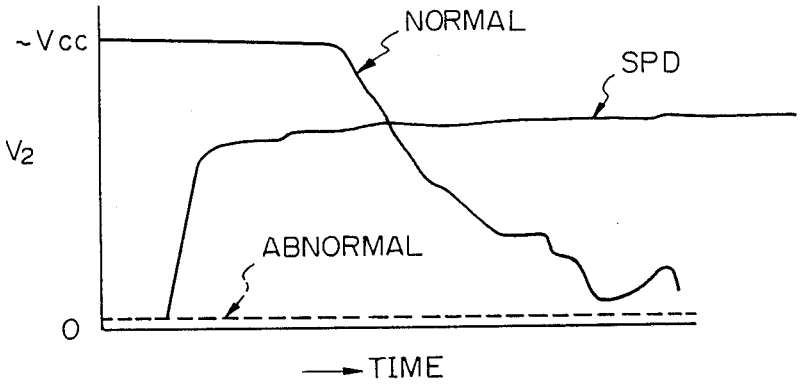
FIG. 8 is a timing diagram explaining the flow chart of FIG. 7.

FIG. 5 is a starting mode routine which is a part of a main routine. This starting mode routine also servers as a short-circuit detecting routine for the downstream-side $O_2$ sensor 15, as a first embodiment of the present invention. That is, at step 701, it is determined whether or not the engine is in a starting mode by determining whether or not the starter switch 18 is turned ON (ST="1"). Only when the engine is in a starting mode does the control proceed to steps 702 through 710. At step 702, a start-mode control such as a fuel enrichment is carried out, and at step 703, the RAM 105 and the like are initialized. Next, at step 704, the coolant temperature data THW is read out of the RAM 105, and then it is determined whether or not $THW < THW_0$ (definite value) is satisfied. Only when $THW < THW_0$ does the control proceed to step 705, which performs an A/D conversion upon the output $V_2$ of the downstream-side $O_2$ sensor 15, and then it is determined whether or not $V_2 < V_0$ is satisfied. Note that $V_0$ is a definite value close to 0 V. That is, as illustrated in FIG. 8, when the engine is in a starting mode and in a cold state, the air-fuel ratio is rich. Therefore, when the downstream-side $O_2$ sensor 15 is not short-circuited, the output $V_2$ of the downstream-side $O_2$ sensor 15, which is the same as that of the pull-up type input circuit 112, is at a high level close to $V_{cc}$, such as 5V. On the other hand, when the downstream-side $O_2$ sensor 15 is short circuited, the output $V_2$ thereof is at a low level close to 0V. Therefore, at step 706, it is determined whether the output $V_2$ of the downstream side $O_2$ sensor 15 is low (short-circuited), or high (normal). As a result, if $V_2 < V_0$, the control proceeds to step 707 to 709, which carry out a postprocess of the detection of a short-circuit. On the other hand, if $V_2 \geqq V_0$, the control proceeds to step 710 which resets a short-circuit failure flag FB (FB="0").

The process at steps 707 to 709 will be explained below. At step 707, the alarm 19 is activated, and at step 708 a learning value $\overline{RSR}$ of a rich skip amount RSR, which is an air-fuel ratio feedback control amount by the output $V_2$ of the downstream-side $O_2$ sensor 15, is initialized. That is, the learning value $\overline{RSR}$ is made 5% and then stored on the backup RAM 106. Next, at step 709, the failure flag FB is set (FB="1").

Figure 7:
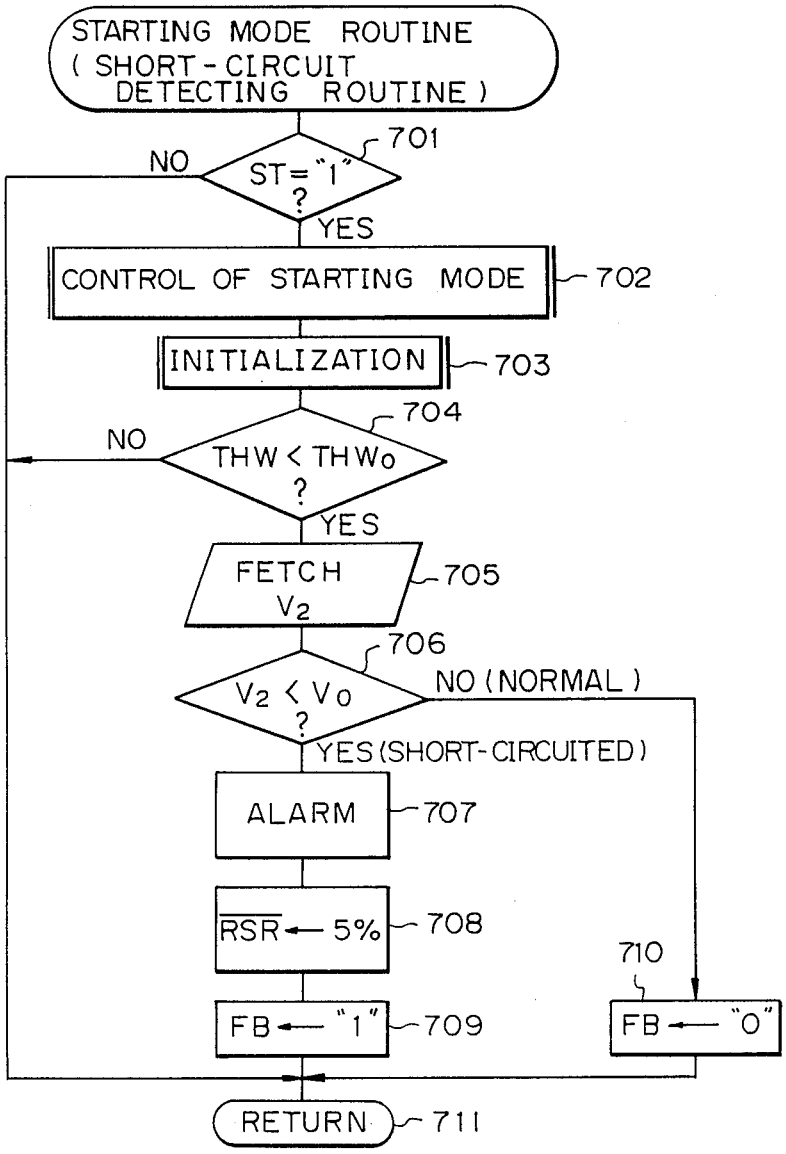

The routine of FIG. 7 is then completed by step 711.

Thus, when the output $V_2$ of the downstream-side $O_2$ sensor 15 is at a low level close to 0V during a starting mode at a cold state, the downstream-side $O_2$ sensor 15 is determined to be short-circuited.

At step 708, note that, where a double $O_2$ sensor system issuing a second air-fuel ratio correction amount FAF2 (see FIG. 14), the learning value $\overline{FAF2}$ of the second air-fuel ratio correction amount FAF2 is initialized. For example, the learning value FAF2 is made 1.0.

Figure 9:
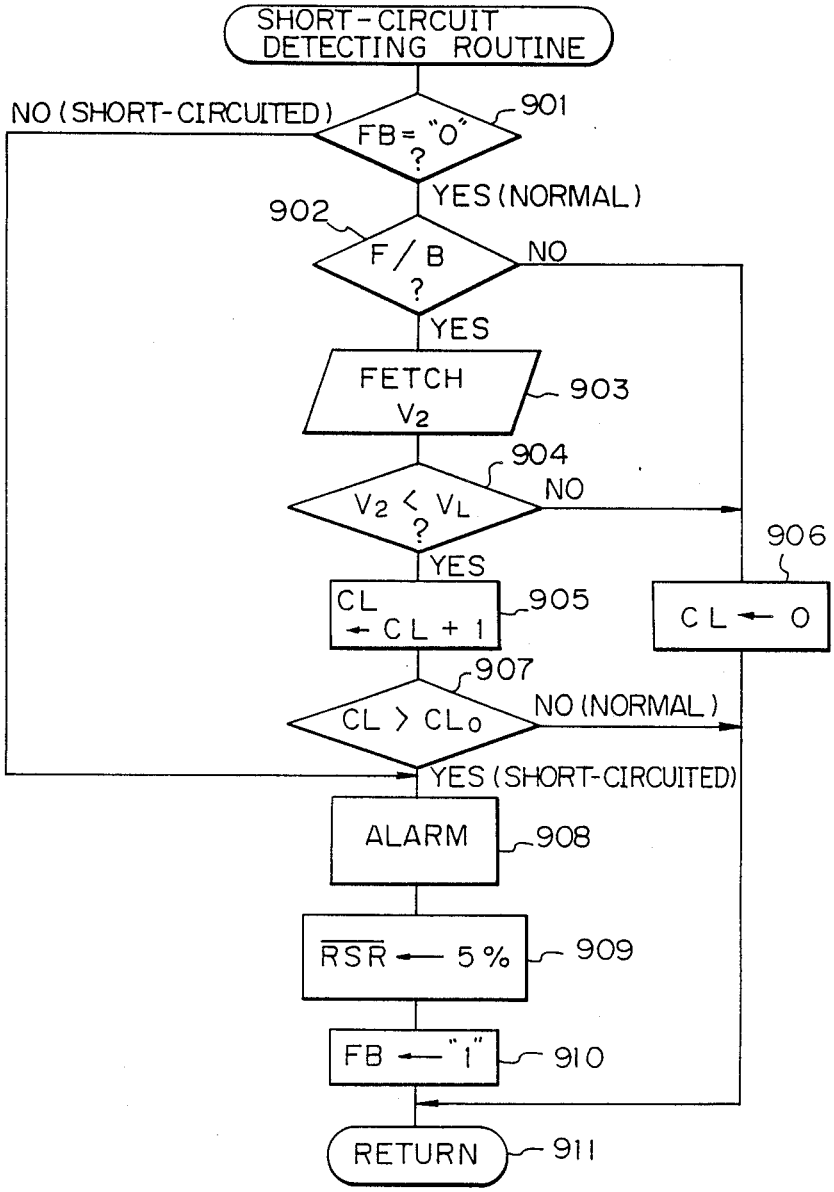

FIG. 9 is also a routine for detecting a short-circuited state in the downstream-side $O_2$ sensor 15 as a second embodiment of the present invention. This routine is carried out at a predetermined time period such as 1 s. At step 901, it is determined whether or not the downstream-side $O_2$ sensor 15 is already short-circuited (FB="1"). If a short-circuit exists (FB="1"), the control proceeds to steps 908 through 910, which carry out a post-process of the detection of a short-circuit, and if a short-circuit does not exist (FB="0"), the control proceeds to step 9O2 through 906.

At step 9O2, it is determined whether or not the air-fuel ratio feedback control by the downstream-side $O_2$ sensor 15 is carried out, i.e., all the air-fuel ratio feedback control conditions by the downstream-side $O_2$ sensor 15 are satisfied. Note that these conditions correspond to those of steps 1401 through 1405 of FIG. 14, which will be later explained. As a result, when the air-fuel ratio feedback control by the downstream-side $O_2$ sensor 15 is not carried out, the control proceeds to step 906 which resets a counter CL for counting the number of occurrences of an abnormal state. Alternatively, the control proceeds to step 903.

Figure 10:
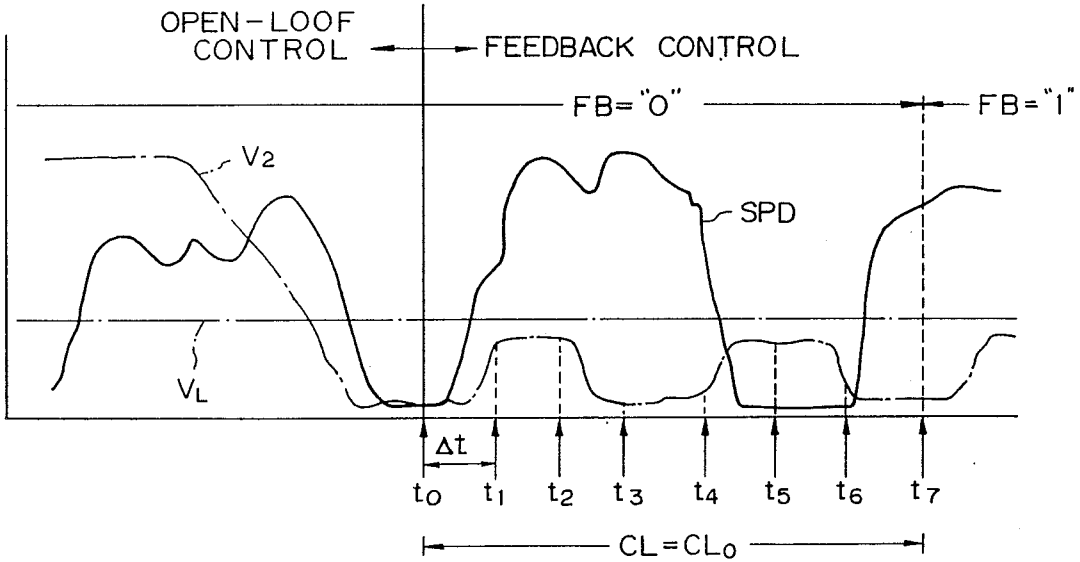
FIG. 10 is a timing diagram explaining the flow chart of FIG. 9.

At step 903, an A/D conversion of the output $V_2$ of the downstream-side $O_2$ sensor 15 is performed, and at step 904, it is determined whether or not the output $V_2$ of the downstream-side $O_2$ sensor 15 is lower than a predetermined level $V_L$, which is a relatively high level as shown in FIG. 10. As a result if $V_2 < V_L$, the control proceeds to step 905 which increases the abnormal state counter CL by +1. Alternatively, the control proceeds to step 906 which clears the abnormal state counter CL. That is, the counter CL is used for counting the number of continuous occurrences where $V_2 < V_L$.

At step 907, it is determined whether or not the counter CL reaches a predetermined value $CL_0$. If $CL > CL_0$, it is judged that the downstream-side $O_2$ sensor 15 is short-circuited, and the control then proceeds to steps 908 to 910, which carry out a postprocess of the detection of a short-circuit. Note that steps 908 to 910 correspond to steps 707 to 709, respectively.

The routine of FIG. 9 is then completed by step 911.

Thus, as illustrated in FIG. 10, after the air-fuel ratio feedback control conditions by the downstream-side $O_2$ sensor 15 are satisfied, the output $V_2$ of the downstream-side $O_2$ sensor 15 is compared with the predetermined level $V_L$ at times $t_0, t_1, t_2, \ldots$, i.e., at every time period $\Delta t$, and as a result, when the number of continuous occurrences where $V_2 < V_L$ reaches $CL_0$, the downstream-side $O_2$ sensor 15 is determined to be short-circuited.

Figure 11:
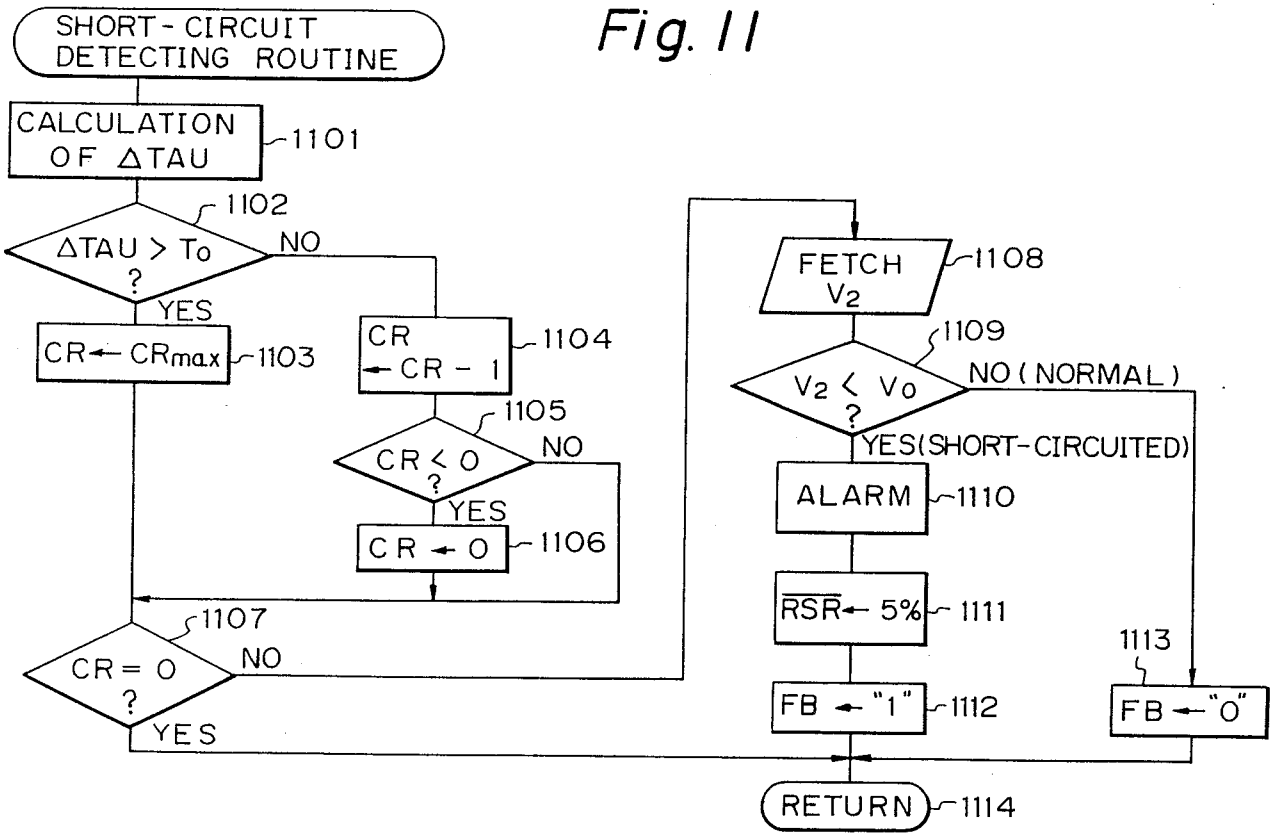

FIG. 11 is a further routine for detecting a short-circuited state in the downstream-side $O_2$ sensor 15, which is carried out at a predetermined time period. At step 1101, a fuel incremental amount ΔTAU is calculated by $$\Delta TAU \leftarrow FPOWER + FOTP$$

where FPOWER is a power fuel incremental amount calculated in accordance with the opening of the throttle valve 16 and the like, which is used for increasing the output of the engine in a high load state, and FOTP is an over temperature fuel incremental amount calculated in accordance with the intake air amount Q and the engine speed Ne, which is used for preventing overheating of the catalyst converter 12, the exhaust pipe 14, and the like. Note that other fuel incremental amounts can be added to ΔTAU, as occasion demands. Next, at step 112, it is determined whether or not $\Delta TAU > T_0$ (definite value) is satisfied. If $\Delta TAU \leqq T_0$, the control proceeds to step 1104 which sets a predetermined value $CR_{max}$ in a incremental counter CR. Alternatively, the control proceeds to step 1104 which decreases the incremental counter CR by 1 and then, at steps 1105 and 1106, the value of the incremental counter CR is guarded by 0. That is, even when the fuel incremental amount ΔTAU is increased and thereafter decreased, the engine actually remains in a fuel incremental state for a predetermined time period which, in this case, is represented by $CR_{max}$. This is why the incremental counter CR is provided.

At step 1107, it is determined whether or not the engine is actually in a fuel incremental state by the incremental counter CR. If not in a fuel incremental state (CR=0), the control proceeds directly to step 1114, and if in a fuel incremental state ($CR \neq 0$), the control proceeds steps 1108 through 1113. Note that steps 1108 through 1113 correspond to steps 705 through 710, respectively, of FIG. 7.

The routine of FIG. 11 is then completed by step 1114.

Thus, during a fuel incremental state, when the downstream-side $O_2$ sensor 15 is normal, the output V thereof always represents a rich signal (high level). On the other hand, even during a fuel incremental state, when the downstream-side $O_2$ sensor 15 is short-circuited, the output $V_2$ thereof always represents a lean signal (low level). In view of this, according to the routine of FIG. 11, during a fuel incremental state when the output $V_2$ of the downstream-side $O_2$ sensor 15 is at a low level close to 0 V, the downstream-side $O_2$ sensor 15 is determined to be short-circuited.

Next, control of the air-fuel ratio will be explained.

Figures 12, 12A:
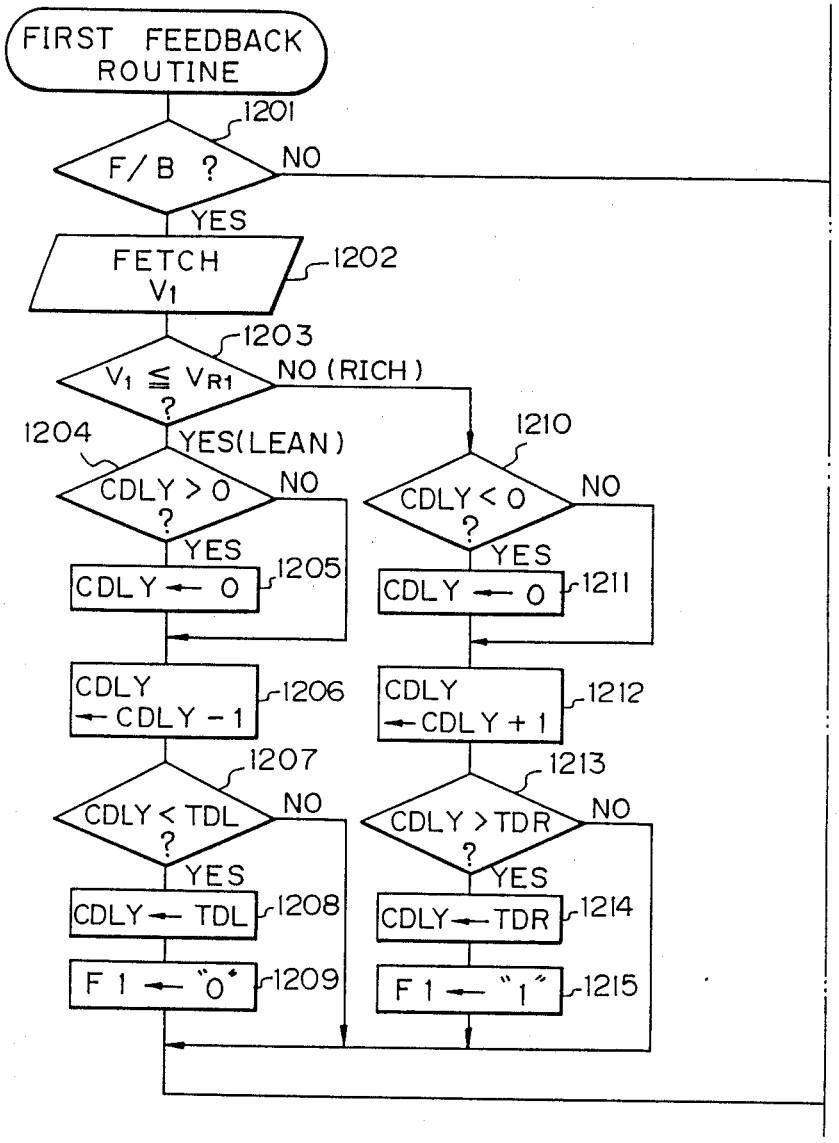
Figure 12B:
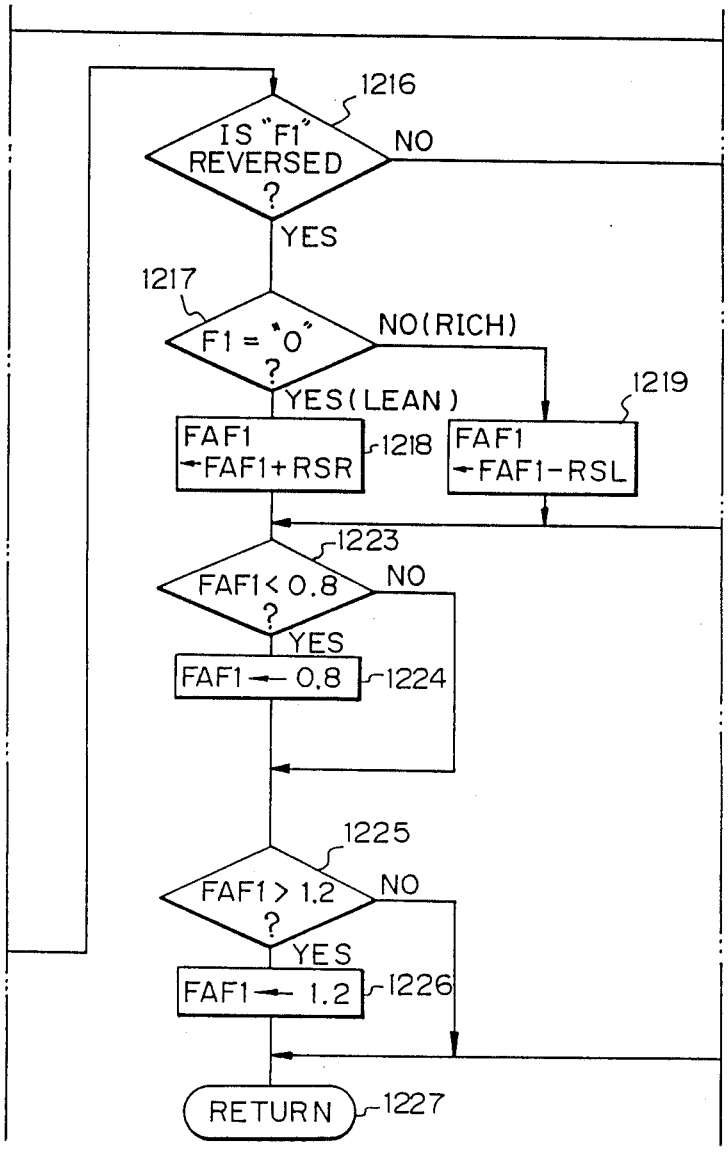
Figure 12C:
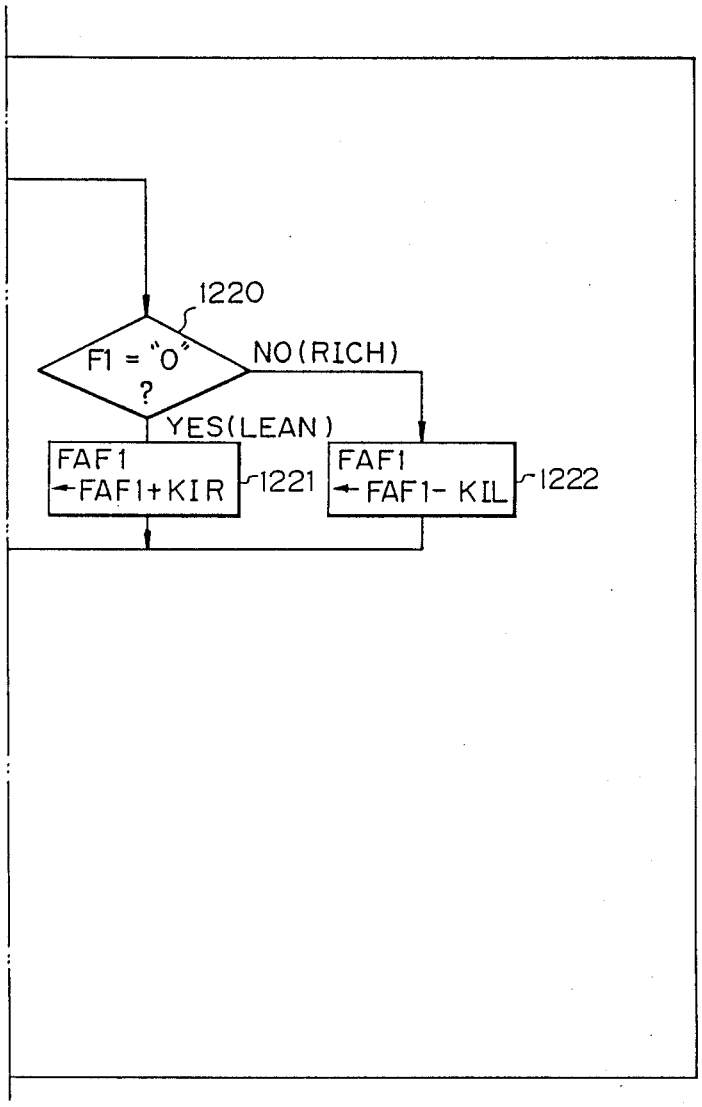

FIG. 12 is a routine for calculating a first air-fuel ratio feedback correction amount FAF1 in accordance with output of the upstream-side $O_2$ sensor 13 executed at every predetermined time period such as 4 ms.

At step 1201, it is determined whether or not all of the feedback control (closed-loop control) conditions by the upstream-side $O_2$ sensor 13 are satisfied. The feedback control conditions are as follows:

(i) the engine is not in a fuel cut-off state;
(ii) the engine is not in a starting state;
(iii) the coolant temperature THW is higher than 50° C.,
(iv) the power fuel incremental amount FPOWER is 0; and
(v) the upstream-side $O_2$ sensor 13 is in an activated state.

Note that the determination of activation/nonactivation of the upstream-side $O_2$ sensor 13 is carried out by determining whether or not the coolant temperature THW ≧70° C., or by whether or not the output voltage $V_1$ of the upstream-side $O_2$ sensor 13, i.e., the output of the pull-up type input circuit 111, is lower than a predetermined value. Of course, other feedback control conditions are introduced as occasion demands, but an explanation of such other feedback control conditions is omitted.

If one of more of the feedback control conditions is not satisfied, the control proceeds directly to step 1227, thereby carrying out an open-loop control operation. In this case, the amount FAF1 is a value immediately before the open-loop control operation. Note that, the amount FAF1 can be a mean value before the open-loop control operation. That is, the amount FAF1 or a mean value $\overline{FAF1}$ thereof is stored in the backup RAM 106, and in an open-loop control operation, the value FAF1 or $\overline{FAF1}$ is read out of the backup RAM 106. Also, during an open-loop control the amount FAF1 can be a definite value such as 1.0.

Contrary to the above, at step 1201, if all of the feedback control conditions are satisfied, the control proceeds to step 1202.

At step 1202, an A/D conversion is performed upon the output voltage $V_1$ of the upstream-side $O_2$ sensor 13, and the A/D converted value thereof is then fetched from the A/D converter 101. Then at step 1203, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 1204, which determines whether or not the value of a delay counter CDLY is positive. If CDLY>0, the control proceeds to step 1205, which clears the delay counter CDLY, and then proceeds to step 1206. If CDLY≦0, the control proceeds directly to step 1206. At step 1206, the delay counter CDLY is counted down by 1, and at step 1207, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 1207, only when CDLY<TDL does the control proceed to step 1208, which causes CDLY to be TDL, and then to step 1208, which causes a first air-fuel ratio flag F1 to be "0" (lean state). On the other hand, if $V_1 > V_{R1}$, which means that the current air-fuel ratio is rich, the control proceeds to step 1210, which determines whether or not the value of the delay counter CDLY is negative. If CDLY>0, the control proceeds to step 1211, which clears the delay counter CDLY, and then proceeds to step 1212. If CDLY>0, the control directly proceeds to 1212. At step 1212, the delay counter CDLY is counted up by 1, and at step 1213, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 1213, only when CDLY>TDR does the control proceed to step 1214, which causes CDLY to be TDR, and then to step 1215, which causes the first air-fuel ratio flag F1 to be "1" (rich state).

Next, at step 1216, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 1217 to 1219, which carry out a skip operation.

At step 1217, if the flag F1 is "0" (lean), the control proceeds to step 1218, which remarkably increases the correction amount FAF1 by a skip amount RSR. Also, if the flag F1 is "1" (rich) at step 1217, the control proceeds to step 1219, which remarkably decreases the correction amount FAF1 by a skip amount RSL.

On the other hand, if the first air-fuel ratio flag F1 is not reversed at step 816, the control proceeds to steps 1220 to 1222, which carries out an integration operation. That is, if the flag F1 is "0" (lean) at step 1220, the control proceeds to step 1221, which gradually increases the correction amount FAF1 by a rich integration amount KIR. Also, if the flag F1 is "1" (rich) at step 1220, the control proceeds to step 1222, which gradually decreases the correction amount FAF1 by a lean integration amount KIL.

The correction amount FAF1 is guarded by a minimum value 0.8 at steps 1223 and 1224. Also, the correction amount FAF1 is guarded by a maximum value 1.2 at steps 1225 and 1226. Thus, the controlled air-fuel ratio is prevented from becoming overlean or overrich.

The correction amount FAF1 is then stored in the RAM 105, thus completing this routine of FIG. 12 at steps 1227.

Figures 13A, 13B, 13C, 13D:
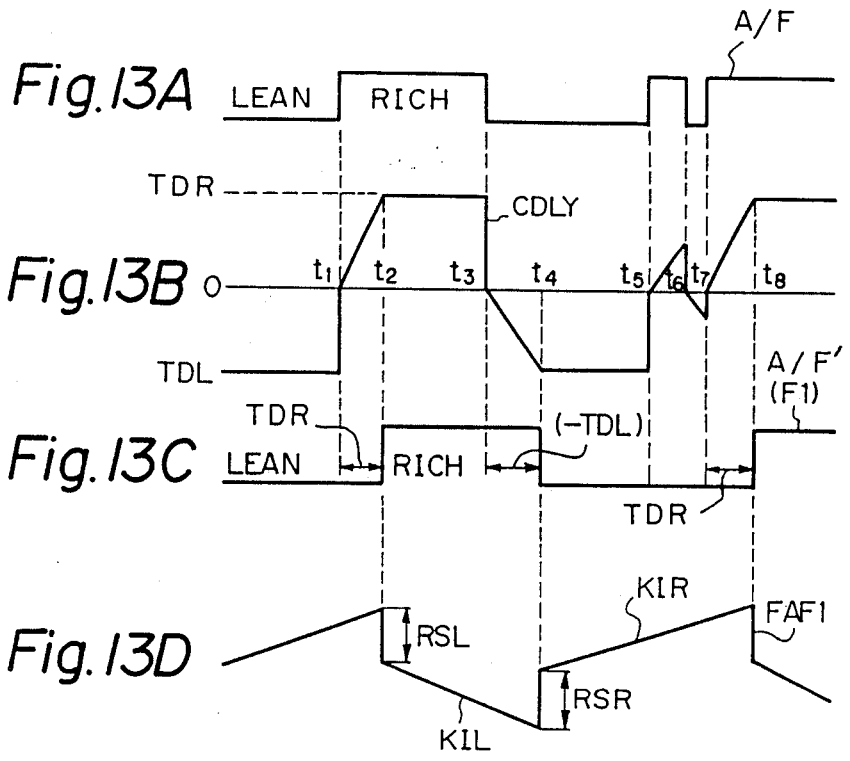
FIGS. 13A through 13D are timing diagrams explaining the flow chart of FIG. 12.

The operation by the flow chart of FIG. 12 will be further explained with reference to FIGS. 13A through 13D. As illustrated in FIG. 13A, when the air-fuel ratio A/F is obtained by the output $V_1$ of the upstream-side $O_2$ sensor 13, the delay counter CDLY is counted up during a rich state, and is counted down during a lean state, as illustrated in FIG. 13B. As a result, a delayed air-fuel ratio corresponding to the first air-fuel ratio flag F1 is obtained as illustrated in FIG. 13C. For example, at time $t_1$, even when the air-fuel ratio A/F is changed from the lean side to the rich side, the delayed air-fuel ratio A/F' (F1) is changed at time $t_2$ after the rich delay time period TDR. Similarly, at time $t_3$, even when the air-fuel ratio A/F is changed from the rich side to the lean side, the delayed air-fuel ratio F1' is changed at time $t_4$ after the lean delay time period TDL. However, at time $t_5$, $t_6$, or $t_7$, when the air-fuel ratio A/F is reversed within a shorter time period than the rich delay time period TDR or the lean delay time period TDL, the delay air-fuel ratio A/F, is reversed at time $t_8$. That is, the delayed air-fuel ratio A/F, is stable when compared with the air-fuel ratio A/F. Further, as illustrated in FIG. 13D, at every change of the delayed air-fuel ratio A/F, from the rich side to the lean side, or vice versa, the correction amount FAF is skipped by the skip amount RSR or RSL, and in addition, the correction amount FAF1 is gradually increased or decreased in accordance with the delayed air-fuel ratio A/F'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich skip amount RSR is ihcreased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor. Also, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Further, if the rich delay time period becomes longer or if the lean delay time period becomes shorter, the controlled air-fuel becomes rich, and if the lean delay time period becomes longer or if the rich delay time period becomes shorter, the controlled air-fuel ratio becomes leaner. Thus, the air-fuel ratio can be controlled by changing the rich delay time period TDR and the lean delay time period—(−TDL) in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 14 and 15.

Figure 14A:
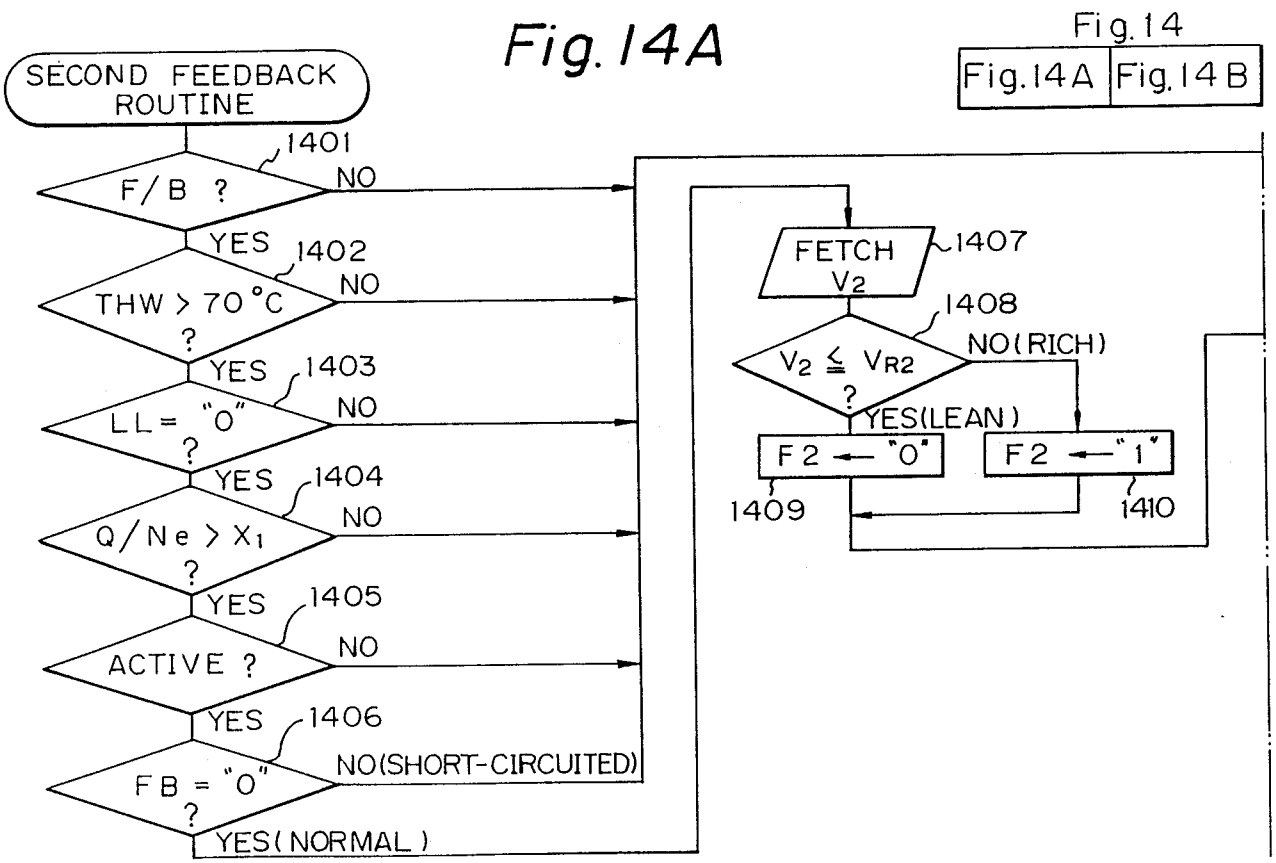
Figure 14B:
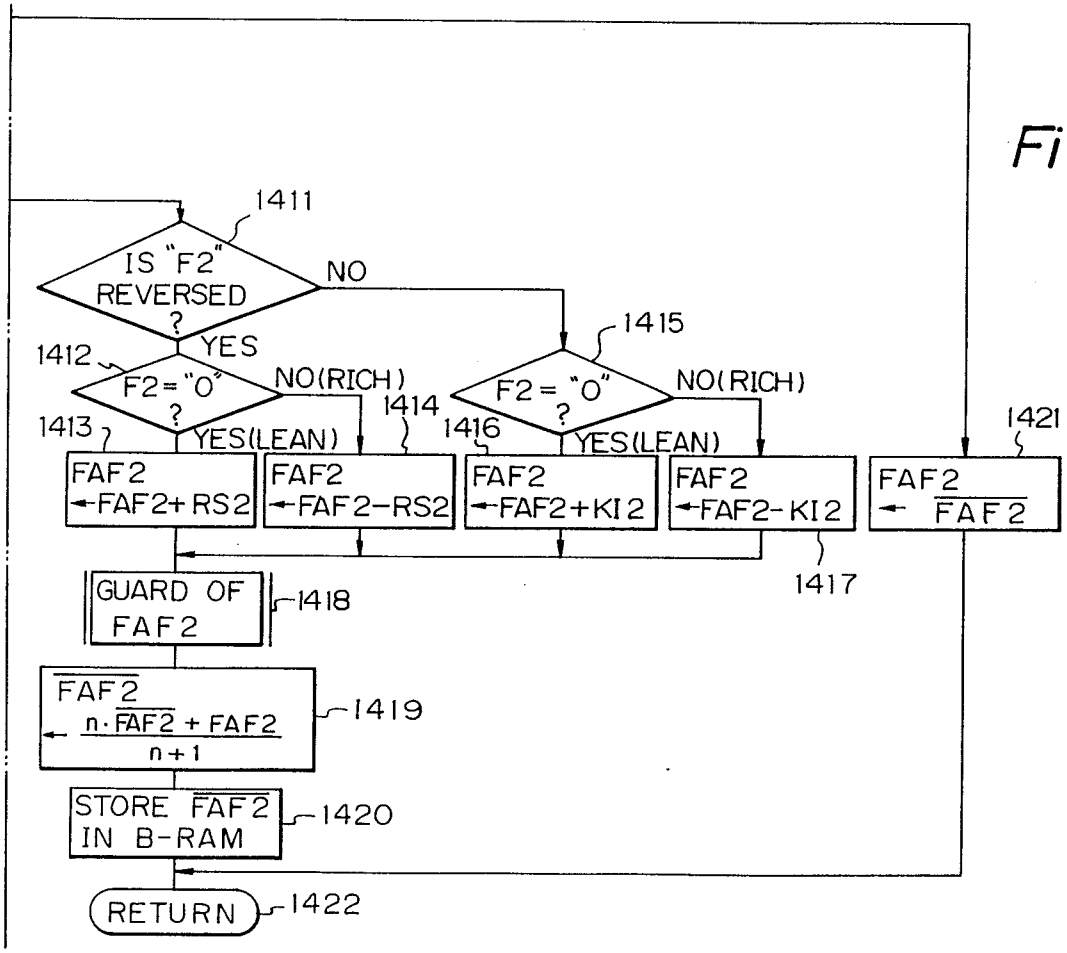

FIG. 14 is a routine for calculating a second air-fuel ratio feedback correction amount FAF2 in accordance with the output of the downstream-side $O_2$ sensor 15 executed at every predetermined time period such as 1 s.

At steps 1401 through 1405, it is determined whether or not all of the feedback control (closed-loop control) conditions by the downstream-side $O_2$ sensor 15 are satisfied. For example, at step 1401, it is determined whether or not the feedback control conditions by the upstream-side $O_2$ sensor 13 are satisfied. At step 1402, it is determined whether or not the coolant temperature THW is higher than 70° C. At step 1403, it is determined whether or not the throttle valve 16 is open (LL="0"). At step 1404, it is determined whether or not a load parameter such as Q/Ne is larger than a predetermined value $X_1$. At step 1405, it is determined whether or not the downstream-side $O_2$ sensor 13 is in an activated state, by whether or not the output voltage $V_2$ of the downstream-side $O_2$ sensor 15, i.e., the output of the pull-up type input circuit 112, is lower than a predetermined value. Of course, other feedback conditions are introduced as occasion demands. For example, a condition of whether or not the secondary air suction system is driven when the engine is in a deceleration state, but an explanation of such other feedback control conditions is omitted.

If one or more of the feedback control conditions is not satisfied, the control proceeds to step 1421, thereby carrying out an open-loop control operation. Note that, in this case, the mean value $\overline{FAF2}$ of the second air-fuel ratio correction amount FAF2 is stored ih the backup RAM 106 and in an open-loop control operation, the value $\overline{FAF2}$ is read out of the backup RAM 106.

Contrary to the above, if all of the feedback control conditions are satisfied, the control proceeds to step 1406.

At step 1406, it is determined whether or not the short-circuit failure flag FB is "1", i.e., whether or not the downstream-side $O_2$ sensor 15 is short-circuited. As a result, when the downstream-side $O_2$ sensor 15 is short-circuited, the control proceeds to step 1421 which carries out an open-loop control operation. In other words, the air-fuel ratio feedback control by the downstream-side $O_2$ sensor 15 is prohibited. On the other hand, when the downstream-side $O_2$ sensor 15 is normal, the control proceeds to step 1407 through 1420.

At step 1407, an A/D conversion is performed upon the output voltage $V_2$ of the downstream-side $O_2$ sensor 15, i.e., the output of the pull-up type input circuit 112, and the A/D converted value thereof is fetched from the A/D converter 101. At step 1408, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

At step 1408, if the air-fuel ratio downstream of the catalyst converter 12 is lean, the control proceeds to step 1409 which resets a second air-fuel ratio flag F2. Alternatively, the control proceeds to the step 1410, which sets the second air-fuel ratio flag F2.

Next, at step 1411, it is determined whether or not the second air-fuel ratio flag F2 is reversed. If the second air-fuel ration flag F2 is reversed, the control proceeds to steps 1412 to 1414 which carry out a skip operation. That is, if the flag F2 is "0" (lean) at step 1412, the control proceeds to step 1413, which remarkably increases the second correction amount FAF2 by a skip amount RS2. Also, if the flag F2 is "1" (rich) at step 1412, the control proceeds to step 1414, which remarkably decreases the second correction amount FAF2 by the skip amount RS2. On the other hand, if the second air-fuel ratio flag F2 is not reversed at step 1411, the control proceeds to steps 1415 to 1417, which carry out an integration operation. That is, if the flag F2 is "0" (lean) at step 1415, the control proceeds to step 1416, which gradually increases the second correction amount FAF2 by an integration amount KI2. Also, if the flag F2 is "1" (rich) at step 1415, the control proceeds to step 1417, which gradually decreases the second correction amount FAF2 by the integration amount KI2.

Note that the skip amount RS2 is larger than the integration amount KI2.

At step 1418, the second correction amount FAF2 is guarded by a minimum value 0.8, and by a maximum value 1.2, thereby also preventing the controlled air-fuel ratio from becoming overrich or overlean.

At step 1419, the learning value $\overline{FAF2}$ of the second air-fuel ratio correction amount FAF2 is read out of the backup RAM 106, and is renewed by $$\overline{FAF2} \leftarrow \frac{n \cdot \overline{FAF2} + FAF2}{n+1}$$

Where n is 15, 31, 63, or the like. Then, at step 1420, the learning value $\overline{FAF2}$ is again stored in the backup RAM 106.

The routine of FIG. 14 is then completed by step 1422.

Thus, when the downstream-side $O_2$ sensor 15 is short-circuited, the air-fuel ratio feedback control is carried out by using the learning value $\overline{FAF2}$ stored in the backup RAM 106. Note that, in this case, the learning value FAF2 is initialized at step 708 of FIG. 7, at step 909, of FIG. 9, or at step 1111 of FIG. 11, i.e., $\overline{FAF2} \leftarrow 1.0$.

Figure 15:
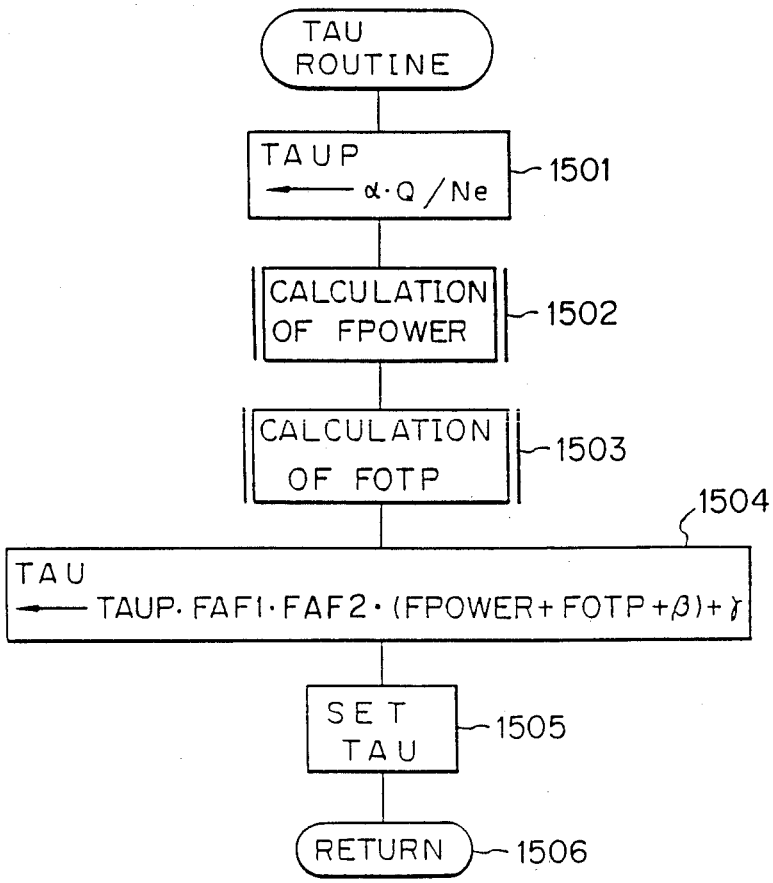

FIG. 15 is a routine for calculating a fuel injection amount TAU executed at every predetermined crank angle such as 360° CA. At step 1501, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1502, a power fuel incremental amount FPOWER is calculated from a two-dimensional map stored in the ROM 104 by using the opening of the throttle valve 16 and the value Q/Ne. Also, at step 1503, an overtemperature fuel incremental amount FOTP is calculated from a two-dimensional map stored in the ROM 104 by using the intake air amount Q and the engine speed Ne. At step 1504, a final fuel injection amount TAU is calculated by $$TAU \leftarrow TAUP \cdot FAF1 \cdot FAF2 \cdot (FPOWER + FOTP + \beta) + \gamma$$

where $\beta$ and $\gamma$ are correction factors determined by other parameters such as the voltage of the battery and the temperature of the intake air. At step 1505, the final fuel injection amount TAU is set in the down counter 107, and in addition, the flip-flop 108 is set to initiate the activation of the fuel injection valve 7. Then, this routine is completed by step 1505. Note that, as explained above, when a time period corresponding to the amount TAU has passed, the flip-flop 109 is reset by the borrow-out signal of the down counter 108 to stop the activation of the fuel injection valve 7.

A double $O_2$ sensor system, in which an air-fuel ratio feedback control parameter of the first air-fuel ratio feedback control by the upstream-side $O_2$ sensor is variable, will be explained with reference to FIGS. 16 and 17. In this case, the skip amounts RSR and RSL as the air-fuel ratio feedback control parameters are variable.

Figures 16, 16A:
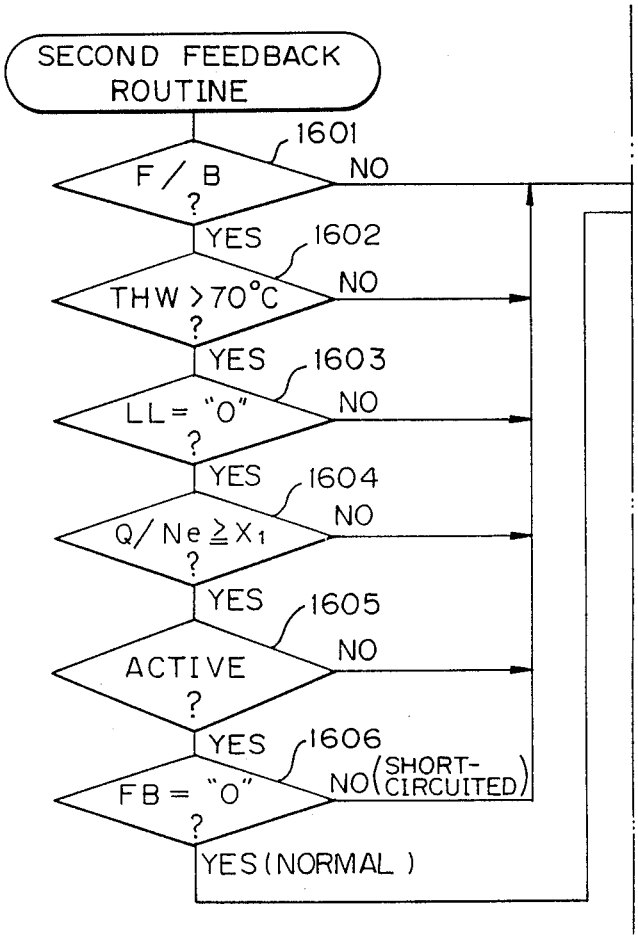
Figure 16B:
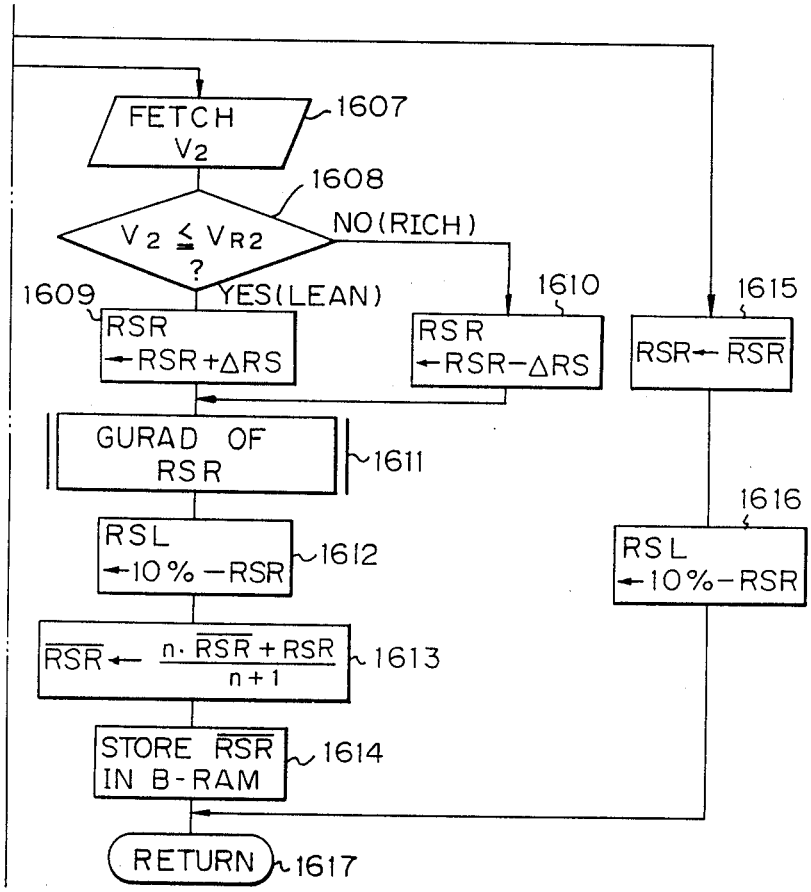

FIG. 16 is a routine for calculating the skip amounts RSR and RSL in accordance with the output $V_2$ of the downstream-side $O_2$ sensor 15 executed at every predetermined time period such as 1 s.

Steps 1601 through 1606 are the same as steps 1401 through 1406 of FIG. 14. That is, if one or more of the feedback control conditions is not satisfied, or if the short-circuit failure flag FB is "1", the control proceeds to steps 1615 and 1616, thereby carrying out an open-loop control operation. That is, at step 1615, the learning value $\overline{RSR}$ is read out of the backup RAM 106, and the rich skip amount RSR is replaced by $\overline{RSR}$. Then, at step 1616, the lean skip amount RSL is calculated by $$RSL \leftarrow 10\% - RSR.$$

Contrary to the above, if all of the feedback control conditions are satisfied and the short-circuit failure flag FB is "0", the control proceeds to steps 1607 through 1614.

At step 1607, an A/D conversion is performed upon the output voltage $V_2$ of the downstream-side $O_2$ sensor 15, i.e., the output of the pull-up type input circuit 112, and the A/D converted value thereof is fetched from the A/D converter 101. At step 1608, the voltage $V_2$ is compared with a reference voltage $V_{R2}$, thereby determining whether the current air-fuel ratio detected by the downstream-side $O_2$ sensor 15 is on the rich side or on the lean side with respect to the stoichiometric air-fuel ratio. As a result, at step 608, if the air-fuel ratio downstream of the catalyst converter 12 is lean, the control proceeds to step 1609. Alternatively, the control proceeds to the step 1610.

At step 1609, the rich skip amount RSR is increased 35 by ΔRS to move the air-fuel ratio to the rich side. On the other hand, at step 1610, the rich skip amount RSR is decreased by ΔRS to move the air-fuel ratio to the lean side. At step 1611, the rich skip amount RSR is guarded by a maximum value MAX such as 7.5% and a minimum value MIN such as 2.5%. Note that the minimum value MIN is a level by which the transient characteristics of the skip operation using the amounts RSR and RSL can be maintained, and the maximum value MAX is a level by which the drivability is not deteriorated by the fluctuation of the air-fuel ratio.

Then, at step 1612, the lean skip amount RSL is calculated by $$RSL \leftarrow 10\% - RSR.$$

At step 1613, the learning value RSR of the rich skip amount RSR is read out of the backup RAM 106, and is renewed by $$RSR \leftarrow \frac{n \cdot RSR + RSR}{n + 1}$$

Where n is 15, 31, 63, or the like. Then, at step 614, the learning value $\overline{RSR}$ is again stored in the backup RAM 106.

The routine of FIG. 16 is then completed by step 1617.

Thus, when the downstream-side $O_2$ sensor 15 is short-circuited, the air-fuel ratio feedback control is carried out by using the learning value RSR stored in the backup RAM 106. Note that, in this case, the learning value RSR is initialized at step 708 of FIG. 7, at step 909 of FIG. 9, or at step 1111 of FIG. 11, i.e., $\overline{RSR} \leftarrow 5\%$.

Figure 17:
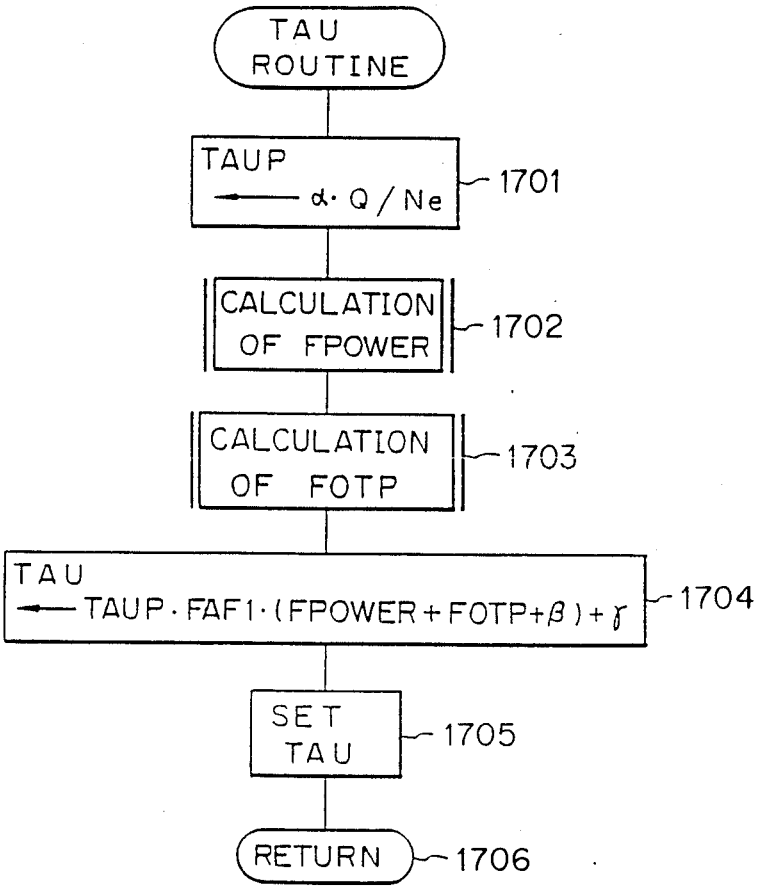

FIG. 17 is a routine for calculating a fuel injection amount TAU executed at every predetermined crank angle such as 360° CA. At step 1701, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1702, a power fuel incremental amount FPOWER is calculated from a two-dimensional map stored in the ROM 104 by using the opening of the throttle valve 16 and the value Q/Ne. Also, at step 1703, an overtemperature fuel incremental amount FOTP is calculated from a two-dimensional map stored in the ROM 104 by using the intake air amount Q and the engine speed Ne. At step 1704, a final fuel injection amount TAU is calculated by $$TAU \leftarrow TAUP \cdot FAF1 \cdot (FPOWER + FOTP + \beta) + \gamma$$

where $\beta$ and $\gamma$ are correction factors determined by other parameters such as the voltage of the battery and the temperature of the intake air. At step 1705, the final fuel injection amount TAU is set in the down counter 107, and in addition, the flip-flop 108 is set to initiate the activation of the fuel injection valve 7. Then, this routine is completed by step 1705. Note that, as explained above, when a time period corresponding to the amount TAU has passed, the flipflop 109 is reset by the borrow-out signal of the down counter 108 to stop the activation of the fuel injection.

Figure 18:
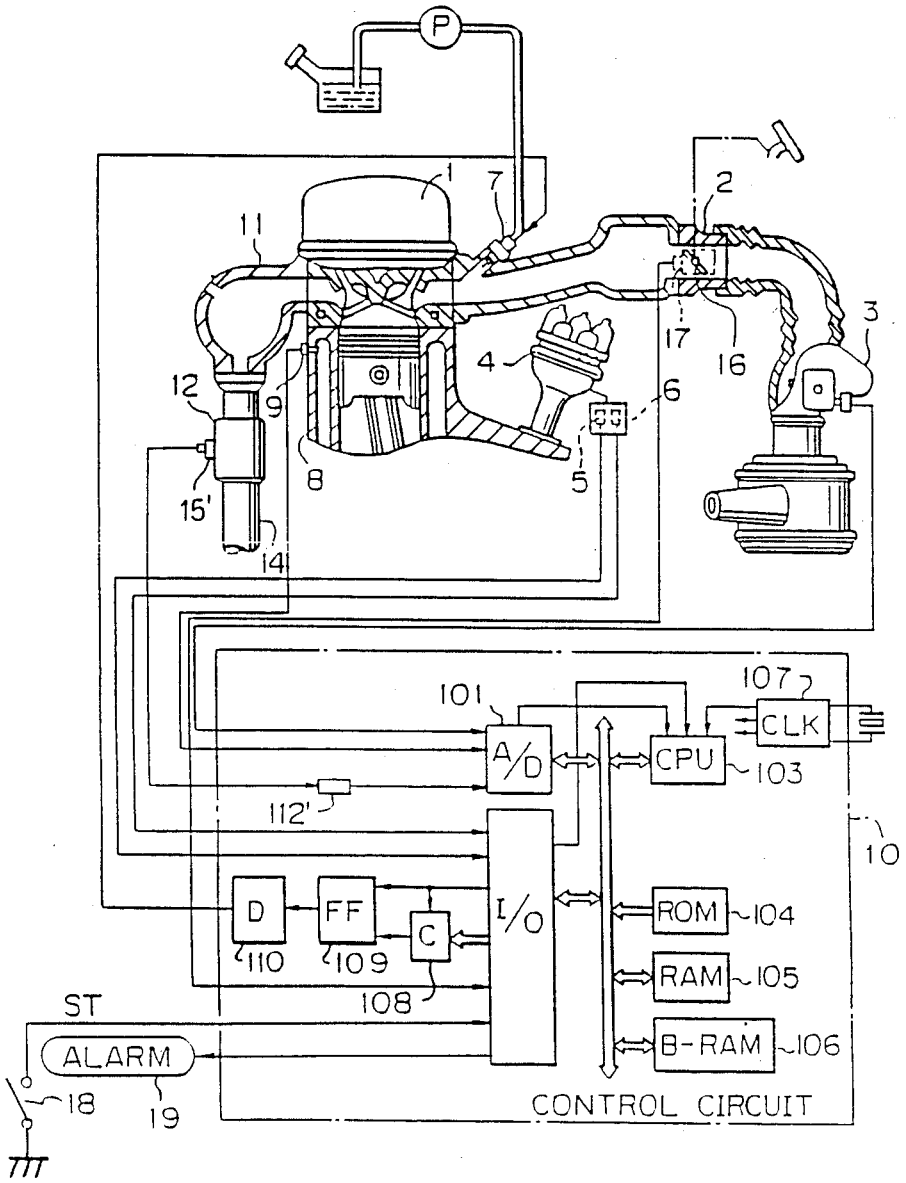
FIGS. 18, 19, and 20 are schematic views of an internal combusion engine according to a single air-fuel ratio sensor system embodiment of the present invention wherein the air-fuel ratio sensor is located within the catalyst converter (FIG. 18), or upstream (FIG. 19) or downstream (FIG. 20) of the catalyst converter.
Figure 19:
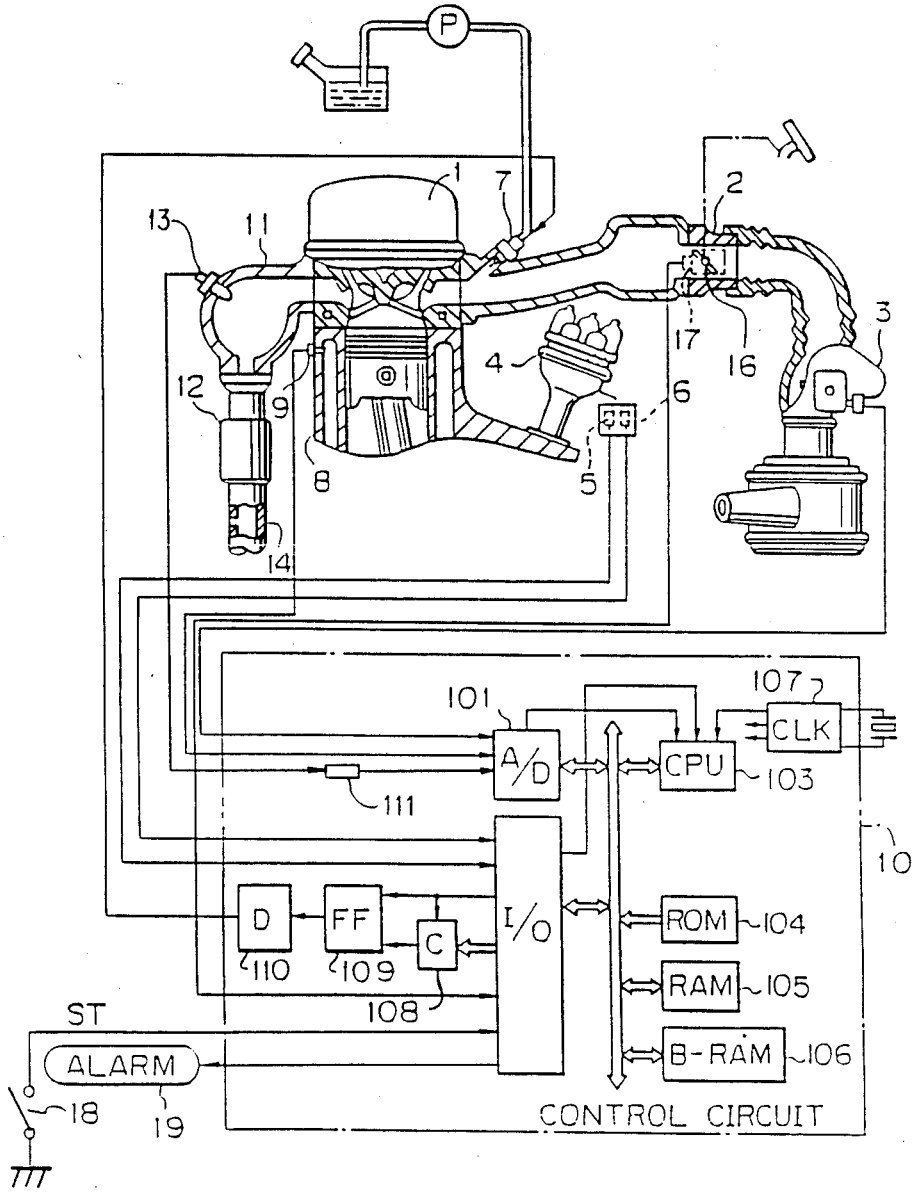
Figure 20:
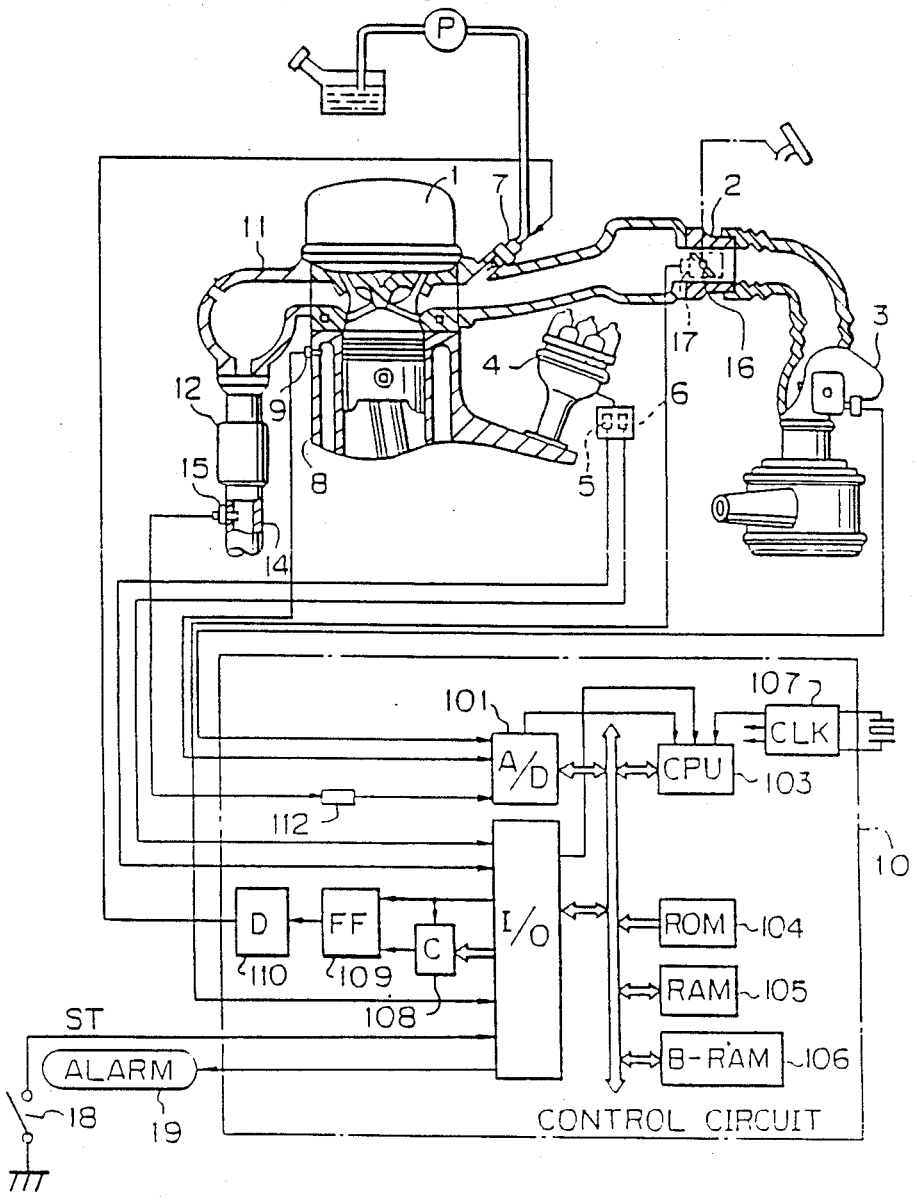

The present invention can be also applied to a single $O_2$ sensor, i.e., where only one $O_2$ sensor 13 is provided upstream of the catalyst converter 12 (FIG. 19). In this case, the routines of FIGS. 14, 16, and 17 are not used, and at steps 705 and 706 of FIG. 7, steps 9O2 and 903 of FIG. 9, and steps 1108 and 1109 of FIG. 11, the output $V_1$ of the upstream-side $O_2$ sensor 13 is fetched and is then compared with the reference volta $V_{R1}$ Further, the present invention can be also applied to a single $O_2$ sensor system where only one $O_2$ sensor 15 is provided downstream of (FIG. 20) or within the catalyst converter 12. FIG. 18 illustrates an $O_2$ sensor 15' in the catalyst converter 12, the output of the $O_2$ sensor 15' being transmitted via a pull-up type input circuit 112' to the A/D converter 101. In this case, the routines of FIGS. 12, 17, and 18 are not used, but the routines of FIGS. 14 and 15 are used. Also, at step 1504 of FIG. 15, the time period TAU is calculated by $$TAU \leftarrow TAUP \cdot FAF2 \cdot (FPOWER + FOTP + \beta) + \gamma.$$

Note that the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. That is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine is which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1501 of FIG. 15 or at step 1701 or FIG. 17 is determined by the carburetor itself, i.e., the intake air negative pressure and the engine speed, and the air amount corresponding to TAU at step 1504 of FIG. 15 or at step 1704 of FIG. 17.

Further, a CO sensor, a lean-mixture sensor or the like can be also used instead of the $O_2$ sensor.

As explained above, according to the present invention, a short-circuited state can be detected in air-fuel ratio sensors connected to pull-up type input circuits, and, therefore, in this case, if an alarm is activated or air-fuel ratio feedback control by such a short-circuited air-fuel ratio sensor, the emission characteristics, the fuel consumption characteristics, and the like can be improved.

I claim:

1. A method for controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream side air-fuel ratio sensor, comprising the steps of:

determining whether or not the output of said pull-up type input circuit is lower than a predetermined activation level;

determining that said downstream-side air-fuel ratio sensor is in an activated state after the output of said pull-up type input circuit is lower than said predetermined active level;

adjusting an actual air-fuel ratio in accordance with the outputs of said upstream-side and downstream-side air-fuel ratio sensors when said downstream-side air-fuel ratio sensor is in an activation state;

determining whether or not said downstream-side air-fuel ratio sensor is short-circuited; and prohibiting the adjustment of said actual air-fuel ratio by the output of said downstream-side air-fuel ratio sensor when said downstream-side air-fuel ratio sensor is short-circuited.

2. A method as set forth in claim 1, wherein said short-circuit determining step comprises the steps of:

determining whether or not said engine is in a starting mode;

determining whether or not said engine is in a cold state; and determining whether or not the output of said downstream-side air-fuel ratio sensor is lower than a predetermined level, when said engine is in a starting mode and in a cold state;

thereby determining that said downstream-side air-fuel ratio sensor is short-circuited, when the output of said downstream-side air-fuel ratio sensor is lower than said predetermined level.

3. A method as set forth in claim 1, wherein said short-circuit determining step comprises the steps of:

determining whether or not the output of said downstream-side air-fuel ratio sensor is lower than a predetermined level at a predetermined time period;

counting the number of continuous timings when the output of said downstream-side air-fuel ratio sensor is lower than said predetermined level;

determining whether or not the number of continuous timings is larger than a predetermined number, thereby determining that said downstream-side air-fuel ratio sensor is short-circuited, when the number of continuous timings is larger than said predetermined number.

4. A method as set forth in claim 1, wherein said short-circuit determining step comprises the steps of:

determining whether or not said engine is in a fuel enrichment state; and determining whether or not the output of said downstream-side air-fuel ratio sensor is larger than a predetermined level, when said engine is in a fuel enrichment state, thereby determining that said downstream-side air-fuel ratio sensor is short-circuited, when the output of said downstream-side air-fuel ratio sensor is not once larger than said predetermined level.

5. A method as set forth in claim 1, wherein said pull-up type input circuit comprises:

a resistor connected between an output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

6. A method as set forth in claim 1, wherein said actual air-fuel ratio adjusting step comprises the steps of:

calculating a first air-fuel ratio correction amount in accordance with the output of said upstream-side air-fuel ratio sensor;

calculating a second air-fuel ratio correction amount in accordance with the output of said downstream-side air-fuel ratio sensor; and adjusting said actual air-fuel ratio in cordance with said first and second air-fuel ratio correction amounts.

7. A method as set forth in claim 1, wherein said actual air-fuel ratio adjusting step comprises the steps of:

calculating an air-fuel ratio feedback control parameter in accordance with the output of said downstream-side air-fuel ratio sensor;

calculating an air-fuel ratio correction amount in accordance with the output of said upstream-side air-fuel ratio sensor and said air-fuel ratio feedback control parameter; and adjusting said actual air-fuel ratio in accordance with said air-fuel ratio correction amount.

8. A method as set forth in claim 7, wherein said arr-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

9. A method as set forth in claim 7, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

10. A method as set forth in claim 7, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

11. A method as set forth in claim 7, wherein said air-fuel ratio feedback control parameter is determined by a reference voltage with which the output of said upstream-side air-fuel ratio sensor is compared, thereby determining whether the air-fuel ratio is on the rich side or on the lean side.

12. A method for controlling an air-fuel ratio in an internal combustion engine having a catalyst converter for removing pollutants in the exhaust gas thereof, an air-fuel ratio sensor disposed upstream or downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising the steps of:

determining whether or not the output of said pull-up type input circuit is lower than a predetermined activation level;

determining that said air-fuel ratio sensor is in an activated state after the output of said pull-up type input circuit is lower than said predetermined active level;

adjusting an actual air-fuel ratio in accordance with the output of said air-fuel ratio sensor when said air-fuel ratio sensor is in an activation state;

determining whether or not said air-fuel ratio sensor is short-circuited; and prohibiting the adjustment of said actual air-fuel ratio by the output of said air-fuel ratio sensor when said air-fuel ratio sensor is short-circuited.

13. A method as set forth in claim 12, wherein said short-circuit determining step comprises the steps of:

determining whether or not said engine is in a starting mode;

determining whether or not said engine is in a cold state; and determining whether or not the output of said air-fuel ratio sensor is lower than a predetermined level, when said engine is in a starting mode and in a cold state, thereby determining that said air-fuel ratio sensor is short-circuited, when the output of said air-fuel ratio sensor is lower than said predetermined level.

14. A method as set forth in claim 12, wherein said short-circuit determining step comprises the steps of:

determining whether or not the output of said air-fuel ratio sensor is lower than a predetermined level at every predetermined time period;

counting the number of continuous timings when the output of said air-fuel ratio sensor is lower than said predetermined level;

determining whether or not the number of continuous timings is larger than a predetermined number, thereby determining that said air-fuel ratio sensor is short-circuited, when the number of continuous timings is larger than said predetermined number.

15. A method as set forth in claim 12, wherein said short-circuit determining step comprises the steps of:

determining whether or not said engine is in a fuel enrichment state; and determining whether or not the output of said air-fuel ratio sensor is larger than a predetermined level, when said engine is in a fuel enrichment state, thereby determining that said air-fuel ratio sensor is short-circuited, when the output of said air-fuel ratio sensor is not once larger than said predetermined level.

16. A method as set forth in claim 12, wherein said pull-up type input circuit comprises:

a resistor connected between the output of said air-fuel ratio sensor and a high power supply terminal; and a capacitor connected between the output of said air-fuel ratio sensor and a low power supply terminal, the connection node of said resistor and said capacitor serving as the output of said pull-up type input circuit.

17. A method as set forth in claim 12, wherein said actual air-fuel ratio adjusting step comprises the steps of:

calculating an air-fuel ratio correction amount in accordance with the output of said air-fuel ratio sensor; and adjusting said actual air-fuel ratio in accordance with said air-fuel ratio correction amount.

18. A apparatus for controlling an air-fuel ratio in an internal combustion engine having a catalyst converter for removing pollutants in the exhaust gas thereof, upstream-side and downstream-side air-fuel ratio sensors disposed upstream and downstream, respectively, of said catalyst converter, for detecting a concentration of a specific component in the exhaust gas, and a pull-up type input circuit for supplying a differential current to said downstream-side air-fuel ratio sensor and receiving an output of said downstream-side air-fuel ratio sensor, comprising:

means for determining whether or not the output of said pull-up type input circuit is lower than a predetermined activation level;

means for determining that said downstream-side air-fuel ratio sensor is in an activated state after the output of said pull-up type input circuit is lower than said predetermined active level;

means for adjusting an actual air-fuel ratio in accordance with the outputs of said upstream-side and downstream-side air-fuel ratio sensors when said down-stream-side air-fuel ratio sensor is in an activation state;

means for determining whether or not said downstream-side air-fuel ratio sensor is short-circuited; and means for prohibiting the adjustment of said actual air-fuel ratio by the output of said downstream-side air-fuel ratio sensor when said downstream-side air-fuel ratio sensor is short-circuited.

19. An apparatus as set forth in claim 18, wherein said short-circuit determining means comprises:

means for determining whether or not said engine is in a starting mode;

means for determining whether or not said engine is in a cold state; and means for determining whether or not the output of said downstream-side air-fuel ratio sensor is lower than a predetermined level, when said engine is in a starting mode and in a cold state, thereby determining that said downstream-side air-fuel ratio sensor is short-circuited, when the output of said downstream-side air-fuel ratio sensor is lower than said predetermined level.

20. An apparatus as set forth in claim 18, wherein said short-circuit determining means comprises:

means for determining whether or not the output of said downstream-side air-fuel ratio sensor is lower than a predetermined level at every predetermined time period;

means for counting the number of continuous timings when the output of said downstream-side air-fuel ratio sensor is lower than said predetermined level;

means for determining whether or not the number of continuous timings is larger than a predetermined number;

thereby determining that said downstream-side air-fuel ratio sensor is short-circuited, when the number of continuous timings is larger than said predetermined number.

21. An apparatus as set forth in claim 18, wherein said short-circuit determining means comprises:

means for determining whether or not said engine is in a fuel enrichment state; and means for determining whether or not the output of said downstream-side air-fuel ratio sensor is larger than a predetermined level, when said engine is in a fuel enrichment state, thereby determining that said downstream-side air-fuel ratio sensor is short-circuited, when the output of said downstream-side air-fuel ratio sensor is not once larger than said predetermined level.

22. An apparatus as set forth in claim 18, wherein said pull-up type input circuit comprises:

a resistor connected between an output of said downstream-side air-fuel ratio sensor and a high power supply terminal; and a capacitor connected between the output of said downstream-side air-fuel ratio sensor and a low power supply terminal, the connection node of said resistor and said capacitor serving as the output of said pull-up type input circuit.

23. An apparatus as set forth in claim 18, wherein said actual air-fuel ratio adjusting means comprises:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor; and means for adjusting said actual air-fuel ratio in accordance with said first and second air-fuel ratio correction amounts.

24. An apparatus as set forth in claim 18, wherein said actual air-fuel ratio adjusting means comprises:

means for calculating an air-fuel ratio feedback control parameter in accordance with the output of said downstream-side air-fuel ratio sensor;

means for calculating an air-fuel ratio correction amount in accordance with the output of said upstream-side air-fuel ratio sensor and said air-fuel ratio feedback control parameter; and means for adjusting said actual air-fuel ratio in accordance with said air-fuel ratio correction amount.

25. An apparatus as set forth in claim 24, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

26. An apparatus as set forth in claim 24, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

27. An apparatus as set forth in claim 24, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

28. An apparatus as set forth in claim 24, wherein said air-fuel ratio feedback control parameter is determined by a reference voltage with which the output of said upstream-side air-fuel ratio sensor is compared, thereby determining whether the air-fuel ratio is on the rich side or on the lean side.

29. An apparatus for controlling an air-fuel ratio in an internal combustion engine having a catalyst converter for removing pollutants in the exhaust gas thereof, an air-fuel ratio sensor disposed upstream or downstream of or within said catalyst converter, for detecting a concentration of a specific component in the exhaust gas, and a pull-up type input circuit for supplying a differential current to said air-fuel ratio sensor and receiving an output of said air-fuel ratio sensor, comprising:

means for determining whether or not the output of said pull-up type input circuit is lower than a predetermined activation level;

means for determining that said air-fuel ratio sensor is in an activated state after the output of said pull-up type input circuit is lower than said predetermined active level;

means for adjusting an actual air-fuel ratio in accordance with the output of said air-fuel ratio sensor when air-fuel ratio sensor is in an activation state;

means for determining whether or not said air-fuel ratio sensor is short-circuited; and means for prohibiting the adjustment of said actual air-fuel ratio by the output of said air-fuel ratio sensor when said air-fuel ratio sensor is short-circuited.

30. An apparatus as set forth in claim 29, wherein said short-circuit determining means comprises:

means for determining whether or not said engine is in a starting mode;

means for determining whether or not said engine is in a cold state; and means for determining whether or not the output of said air-fuel ratio sensor is lower than a predetermined level, when said engine is in starting mode and in a cold state, thereby determining that said air-fuel ratio sensor is short-circuited, when the output of said air-fuel ratio sensor is lower than said predetermined level.

31. An apparatus as set forth in claim 29, wherein said short-circuit determining means comprises:

means for determining whether or not the output of said air-fuel ratio sensor is lower than a predetermined level at a predetermined time period;

means for counting the number of continuous timings when the output of said air-fuel ratio sensor is lower than said predetermined level;

means for determining whether or not the number of continuous timings is larger than a predetermined number;

thereby determining that said air-fuel ratio sensor is short-circuited, when the number of continuous timings is larger than said predetermined number.

32. An apparatus as set forth in claim 29, wherein said short-circuit determining means comprises:

means for determining whether or not said engine is in a fuel enrichment state; and means for determining whether or not the output of said air-fuel ratio sensor is larger than a predetermined level, when said engine is in a fuel enrichment state;

thereby determining that said air-fuel ratio sensor is short-circuited, when the output of said air-fuel ratio sensor is not once larger than said predetermined level.

33. An apparatus as set forth in claim 29, wherein said pull-up type input circuit comprises:

a resistor connected between the output of said air-fuel ratio sensor and a high power supply terminal; and a capacitor connected between the output of said air-fuel ratio sensor and a low power supply terminal, the connection node of said resistor and said capacitor serving as the output of said pull-up type input circuit.

34. An apparatus as set forth in claim 29, wherein said actual air-fuel ratio adjusting means comprises:

means for calculating an air-fuel ratio correction amount in accordance with the output of said air-fuel ratio sensor; and means for adjusting said actual air-fuel ratio in accordance with said air-fuel ratio correction amount.

* * * * *